US010049846B2

(12) United States Patent
Brakefield

(10) Patent No.: US 10,049,846 B2
(45) Date of Patent: Aug. 14, 2018

(54) FUSE HOLDER AND ASSOCIATED METHOD

(71) Applicant: Regal Beloit America, Inc., Beloit, WI (US)

(72) Inventor: Timothy Joseph Brakefield, Perrysburg, OH (US)

(73) Assignee: Regal Beloit America, Inc., Beloit, WI (US)

( * ) Notice: Subject to any disclaimer, the term of this patent is extended or adjusted under 35 U.S.C. 154(b) by 0 days.

(21) Appl. No.: 15/440,226

(22) Filed: Feb. 23, 2017

(65) Prior Publication Data

US 2017/0162357 A1 Jun. 8, 2017

Related U.S. Application Data

(63) Continuation of application No. 14/463,123, filed on Aug. 19, 2014, now Pat. No. 9,613,776.

(51) Int. Cl.

| | |
|---|---|
| ***H01H 85/20*** | (2006.01) |
| ***H01H 85/22*** | (2006.01) |
| ***H01H 85/54*** | (2006.01) |
| ***H01H 85/143*** | (2006.01) |

(52) U.S. Cl.

CPC ..... *H01H 85/22* (2013.01); *H01H 85/143* (2013.01); *H01H 85/20* (2013.01); *H01H 85/547* (2013.01)

(58) Field of Classification Search

CPC ..... H01H 9/08; H01H 85/20; H01H 85/22; H01H 85/143

USPC ..... 337/186, 227

See application file for complete search history.

(56) References Cited

U.S. PATENT DOCUMENTS

| | | | | |
|---|---|---|---|---|
| 945,017 | A * | 1/1910 | Cole | H01H 85/545 337/186 |
| 1,938,097 | A * | 12/1933 | Curlee | H01H 85/545 337/195 |
| 1,966,716 | A | 7/1934 | Green | |
| 2,072,729 | A | 3/1937 | Corbett | |
| 2,186,813 | A | 1/1940 | Adam et al. | |
| 2,289,122 | A | 7/1942 | Jackson et al. | |
| 2,885,126 | A | 5/1959 | Hudson | |
| 3,030,474 | A | 4/1962 | Scott, Jr. | |
| 3,202,788 | A | 8/1965 | George | |
| 3,358,100 | A | 12/1967 | Schleicher | |
| 3,379,842 | A | 4/1968 | Downs | |
| 3,418,615 | A * | 12/1968 | Canney | H01H 85/20 337/190 |
| 4,559,504 | A | 12/1985 | Krec | |
| 4,778,959 | A | 10/1988 | Sabatella et al. | |
| 4,851,963 | A | 7/1989 | Miller et al. | |

(Continued)

FOREIGN PATENT DOCUMENTS

| | | | |
|---|---|---|---|
| DE | 3741743 | C2 | 1/1997 |
| DE | 102007053535 | A1 | 5/2009 |

(Continued)

*Primary Examiner* — Anatoly Vortman
(74) *Attorney, Agent, or Firm* — John Wagley

(57) ABSTRACT

A holder for receiving fuses is provided. The holder includes a housing and a fuse shuttle. The fuse shuttle is slidably cooperable with the housing in a first portion of the housing and pivotally cooperable with the housing in a second portion of the housing. The fuse shuttle and the housing define a fuse loading position and a fuse operational position.

6 Claims, 19 Drawing Sheets

(56) References Cited

U.S. PATENT DOCUMENTS

| | | | | |
|---|---|---|---|---|
| 4,966,561 | A | 10/1990 | Norden | |
| 5,406,449 | A | 4/1995 | Hicks et al. | |
| 5,559,662 | A | 9/1996 | Happ et al. | |
| 5,616,054 | A * | 4/1997 | Quinlan ..... | H01H 85/545 439/620.26 |
| 5,831,228 | A | 11/1998 | Kuki et al. | |
| 5,833,484 | A | 11/1998 | Post et al. | |
| 5,842,560 | A | 12/1998 | Kuki et al. | |
| 5,847,338 | A | 12/1998 | Kuki et al. | |
| 5,859,580 | A | 1/1999 | Hashizawa et al. | |
| 5,973,418 | A | 10/1999 | Ciesielka et al. | |
| 6,157,287 | A | 12/2000 | Douglass et al. | |
| 6,317,312 | B1 | 11/2001 | Hashizawa et al. | |
| 6,325,647 | B1 | 12/2001 | May et al. | |
| 6,333,846 | B1 | 12/2001 | Hashizawa et al. | |
| 6,366,449 | B1 | 4/2002 | Hashizawa et al. | |
| 6,407,656 | B1 | 6/2002 | Konda et al. | |
| 6,587,028 | B2 | 7/2003 | Mollet et al. | |
| 6,650,222 | B2 | 11/2003 | Darr et al. | |
| 6,717,505 | B1 | 4/2004 | Bruchmann | |
| 6,727,797 | B1 | 4/2004 | Bruchmann | |
| 6,736,655 | B2 | 5/2004 | Martin et al. | |
| 6,784,783 | B2 | 8/2004 | Scoggin et al. | |
| 6,853,289 | B2 | 2/2005 | Scoggin | |
| 6,997,725 | B2 | 2/2006 | Stella et al. | |
| 6,998,954 | B2 | 2/2006 | Milanczak | |
| 7,355,503 | B2 | 4/2008 | Buettner | |
| 7,474,194 | B2 | 1/2009 | Darr et al. | |
| 7,561,017 | B2 | 7/2009 | Darr et al. | |
| 7,750,789 | B2 | 7/2010 | Titokis et al. | |
| 8,384,509 | B2 | 2/2013 | Buettner et al. | |
| 2002/0177338 | A1 | 11/2002 | Nishide et al. | |
| 2003/0199184 | A1 | 10/2003 | Martin et al. | |
| 2005/0098419 | A1 | 5/2005 | Matsui et al. | |
| 2008/0242150 | A1 | 10/2008 | Chikamatsu et al. | |
| 2009/0246992 | A1 | 10/2009 | Martin | |

FOREIGN PATENT DOCUMENTS

| | | | |
|---|---|---|---|
| EP | 0852388 | A1 | 7/1988 |
| EP | 0432652 | A1 | 12/1990 |
| FR | 2877138 | A1 | 4/2006 |

* cited by examiner

FUSE HOLDER AND ASSOCIATED METHOD

CROSS REFERENCE TO RELATED APPLICATIONS

The present application is a continuation application of U.S. application Ser. No. 14/463,123, filed Aug. 19, 2014, the entire disclosure of which is hereby expressly incorporated herein by reference.

BACKGROUND OF THE INVENTION

The field of the invention relates generally to electrical transmission equipment and more specifically to a fuse holder for use in electrical circuits for example those circuits used in electrical transmission equipment.

Fuses are regularly used in electrical circuits to provide protection for electrical components from electrical overloads. Fuses are for example used in electrical transmission equipment to provide protection for electrical components from electrical surges originating from the power line or from excessive electrical loads. Replaceable fuses are often used. These replaceable fuses are often placed in electrical or fuse boxes. The electrical or fuse boxes may be located where they are not easily accessed and may be mounted in any orientation where space permits.

These replaceable fuses are consumed and provide an open circuit when exposed to a sufficient overload. Such replaceable fuses need to be replaced once consumed. Access to such replaceable fuses in electrical or fuse boxes is often difficult, particularly when the fuse box is located in a poorly accessible location.

The fuse may need to be safely replaced without disenabling the power in the line. Once removed, it may be discovered that a replacement fuse is not available which may necessitate that access to a hot power line may need to be prevented when the fuse is not in the holder.

Some fuses are quite large and need to be inserted easily and safely into the fuse box, while not contacting the hot power line. The fuse boxes for these large fuses may accommodate may fuses and are inherently large. Minimizing the size of these fuse boxes may result in making access to the fuses more difficult, as sufficient space between adjacent fuses for accommodation for access by hands into the box may be compromised.

The present invention is directed toward alleviating at least some of the above mentioned difficulties with the prior art.

BRIEF DESCRIPTION OF THE INVENTION

According to an embodiment of the present invention, a holder for receiving fuses is provided. The holder includes a housing and a fuse shuttle. The fuse shuttle is slidably cooperable with the housing in a first portion of the housing and pivotally cooperable with the housing in a second portion of the housing. The fuse shuttle and the housing define a fuse loading position and a fuse operational position.

According to an aspect of the present invention, the holder may be provided wherein the housing and the fuse receiving device are adapted to permit a pivoting movement of the fuse receiving device with respect to the housing of at least 20 degrees.

According to another aspect of the present invention, the holder may be provided wherein the fuse shuttle is permanently secured to the housing.

According to another aspect of the present invention, the holder may be provided wherein the fuses include opposed first and second generally cylindrical ends and wherein the fuse shuttle includes first and second receptacles for receiving the first and second generally cylindrical ends, respectively.

According to another aspect of the present invention, the holder may be provided wherein at least one of the first receptacle and the second receptacle is resilient.

According to another aspect of the present invention, the holder may be provided wherein the fuses include opposed first and second generally cylindrical ends, wherein the fuse shuttle includes spaced apart first and second arms, and wherein the first and second arms of the fuse shuttle includes first and second receptacles, respectively, for receiving the first and second generally cylindrical ends, respectively.

According to another aspect of the present invention, the holder may be provided wherein the housing includes spaced apart first and second housing features and wherein each of the first and second arms include an arm feature for cooperation with the first and second housing features, respectively. The arm features and the housing features are adapted to slidably guide the fuse shuttle in the first portion of the housing.

According to another aspect of the present invention, the holder may be provided wherein at least one of the arm features includes one of a protrusion and a void and wherein at least one of the housing features includes the other of a protrusion and a void.

According to another aspect of the present invention, the holder may be provided wherein the housing includes spaced apart first and second housing features and wherein each of the first and second arms includes an arm feature for cooperation with the first and second housing features, respectively. The arm features and the housing features are adapted to slidably guide the fuse shuttle in the first portion of the housing and are adapted to pivotally guide the fuse shuttle in the second portion of the housing.

According to another aspect of the present invention, the holder may be provided wherein the fuses include opposed first and second generally cylindrical ends, wherein the fuse shuttle includes first and second receptacles for receiving the first and second generally cylindrical ends, respectively, wherein the first receptacle is adapted for axial acceptance of the fuse, and wherein the second receptacle is adapted for transverse acceptance of the fuse.

According to another aspect of the present invention, the holder may be provided wherein the housing includes a housing securing feature and wherein the fuse shuttle includes a member securing feature. The housing securing feature and the member securing feature are adapted to secure the fuse shuttle in fuse operational position when the fuse is positioned in the fuse shuttle and when the fuse is not positioned in the fuse shuttle.

According to another embodiment of the present invention, a holder for receiving fuses is provided. The holder includes a housing and a fuse shuttle. The fuse shuttle is slidably cooperable with the housing in a first portion of the housing and permanently secured to the housing. The fuse shuttle and the housing define a fuse loading position and a fuse operational position.

According to another aspect of the present invention, the holder may be provided wherein the fuse shuttle is slidably cooperable with the housing in a first portion of the housing and pivotally cooperable with the housing in a second portion of the housing.

According to another aspect of the present invention, the holder may be provided wherein the housing and the fuse receiving device are adapted to permit a pivoting movement of the fuse receiving device with respect to the housing of at least 20 degrees.

According to another aspect of the present invention, the holder may be provided wherein the fuses include opposed first and second generally cylindrical ends and wherein the fuse shuttle includes first and second receptacles for receiving the first and second generally cylindrical ends, respectively.

According to another aspect of the present invention, the holder may be provided wherein at least one of the first receptacle and the second receptacle is resilient.

According to another aspect of the present invention, the holder may be provided wherein at least one of the first receptacle and the second receptacle includes a plurality of spaced apart arcuate portions.

According to another aspect of the present invention, the holder may be provided wherein at least one of the first receptacle and the second receptacle includes a portion thereof that is relieved to assist in loading of the fuse.

According to another aspect of the present invention, the holder may be provided wherein at least one of the first receptacle and the second receptacle includes an axially extending chamfer.

According to another aspect of the present invention, the holder may be provided wherein the fuses include opposed first and second generally cylindrical ends, wherein the fuse shuttle includes first and second receptacles for receiving the first and second generally cylindrical ends, respectively, wherein the first receptacle is adapted for axial acceptance of the fuse, and wherein the second receptacle is adapted for transverse acceptance of the fuse.

According to another embodiment of the present invention, a method for installing a fuse in a fuse holder is provided. The method includes the step of providing a fuse holder having a housing and the step of providing a fuse receiving member pivotally positionable in the housing in a first portion thereof and slidably positionable in the housing in a second portion thereof. The method also includes the step of pivotably positioning the fuse receiving member into a fuse loading position and the step of inserting the fuse into the fuse receiving member. The method also includes the step of pivotably positioning the fuse receiving member into a fuse installation position and the step of slidably advancing the fuse receiving member into a fuse operational position.

According to an aspect of the present invention, the method may be provided wherein the inserting step includes inserting a first end of the fuse into a first receptacle of the fuse receiving member in an axial direction and inserting an opposed second end of the fuse into a second receptacle of the fuse receiving member in a radial direction.

According to another aspect of the present invention, the method may be provided wherein the pivotably positioning step includes pivotably positioning the fuse receiving member into a fuse loading position in one of a clockwise and a counterclockwise direction.

DETAILED DESCRIPTION OF THE INVENTION

Fuses are regularly used in electrical circuits to provide protection for electrical components from electrical overloads. Fuses are, for example, used in electrical transmission equipment to provide protection for electrical components from electrical surges originating from the power line or from excessive electrical loads. Replaceable fuses are often used. These replaceable fuses are often placed in electrical or fuse boxes. The electrical or fuse boxes may be located where they are not easily accessed and may be mounted in any orientation where space permits. These replaceable fuses are consumed and provide an open circuit when exposed to a sufficient overload. Such replaceable fuses need to be replaced once consumed.

Access to such replaceable fuses in electrical or fuse boxes is often difficult, particularly when the fuse box is located in a poorly accessible location.

Further, the fuse may need to be safely replaced without disenabling the power in the line. Once removed, it may be discovered that a replacement fuse is not available which may necessitate that access to a hot power line may need to be prevented when the fuse is not in the holder.

Further, some fuses are quite large and need to be inserted easily and safely into the fuse box, while not contacting the hot power line. The fuse boxes for these large fuses may accommodate may fuses and are inherently large. Minimizing the size of these fuse boxes may result in making access to the fuses more difficult, as sufficient space between adjacent fuses for accommodation for access by hands into the box may be compromised.

Fuses may be positioned between a power line and a load. Conversely, fuses may be positioned between power producing devices, such as wind mills or solar panels and the power line/power grid that may receive the power generated by such power producing devices.

Figure 1:
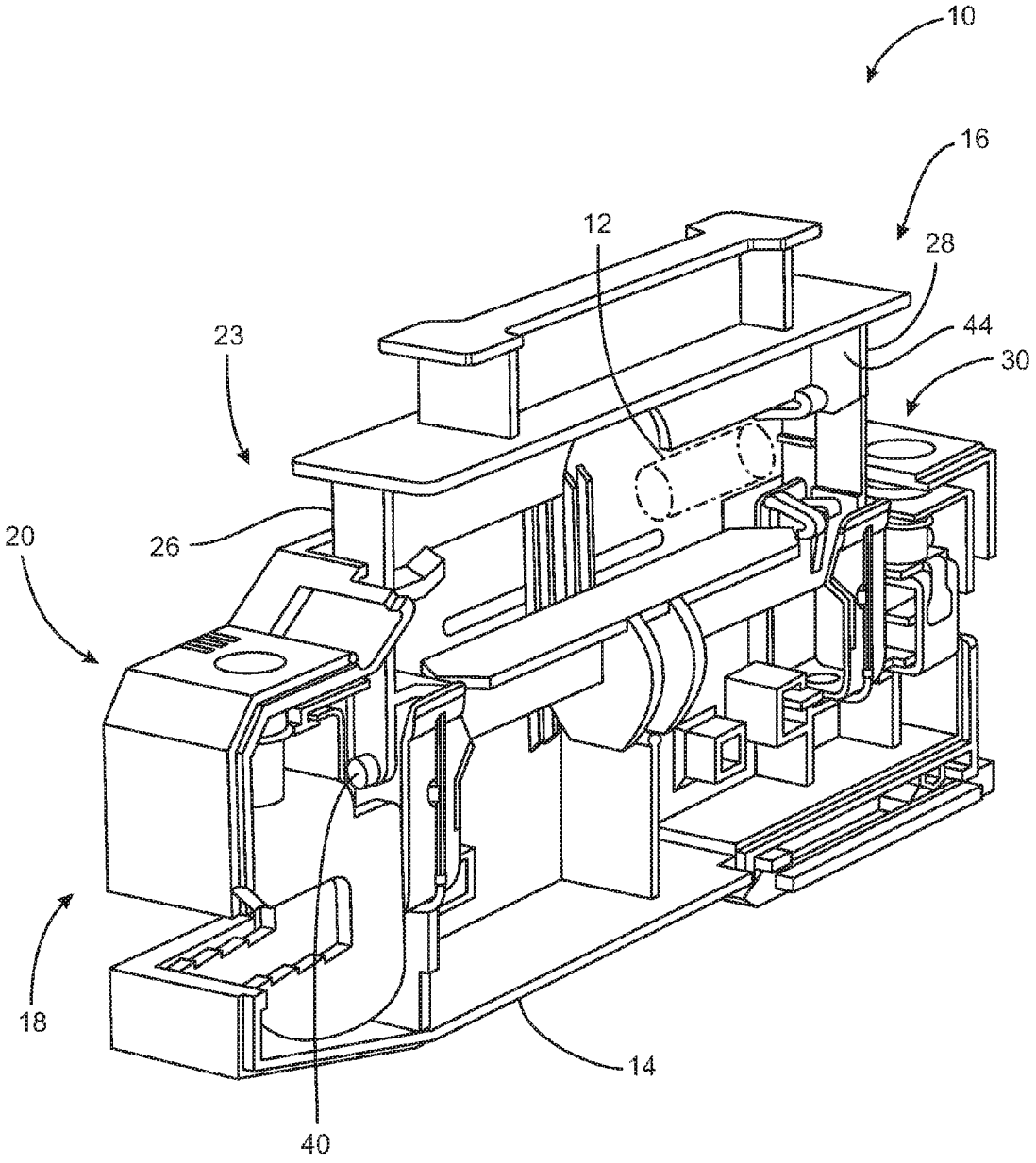
FIG. 1 is a perspective view of an exemplary fuse holder.

According to an embodiment of the present invention and referring now to FIG. 1, a holder 10 for receiving fuses 12, shown in phantom, is provided. The holder 10 includes a housing 14 and a fuse shuttle or fuse receiving member 16. The fuse shuttle 16 is movably, for example slidably, cooperable with the housing 14 in a first portion 18 of the housing 14 (see FIG. 1) and pivotally cooperable with the housing 14 in a second portion 20 of the housing 14 (see FIG. 2). The fuse shuttle 16 and the housing 14 define a fuse loading position 22 (see FIG. 2) and a fuse operational position 24 (see FIG. 3).

As shown in FIG. 1, the holder 10 may have any suitable shape capable of receiving fuses 12. The housing 14 and the fuse shuttle 16 may have any suitable shape capable of providing for the sliding of the fuse shuttle 16 with respect to the housing 14 in the first portion 18 of the housing 14 and capable of providing for the pivoting of the fuse shuttle 16 with respect to the housing 14 in the second portion 20 of the housing 14.

For example and as shown in FIG. 1, the fuse shuttle 16 may include fuse shuttle guiding features 23. The fuse shuttle guiding features 23 may be positioned anywhere in the fuse shuttle 16. For example, the fuse shuttle guiding features 23 may be located in, for example, opposed first and second arms, 26 and 28 respectfully. The fuse shuttle guiding features 23 may cooperate with housing guiding features 30.

Figure 4:
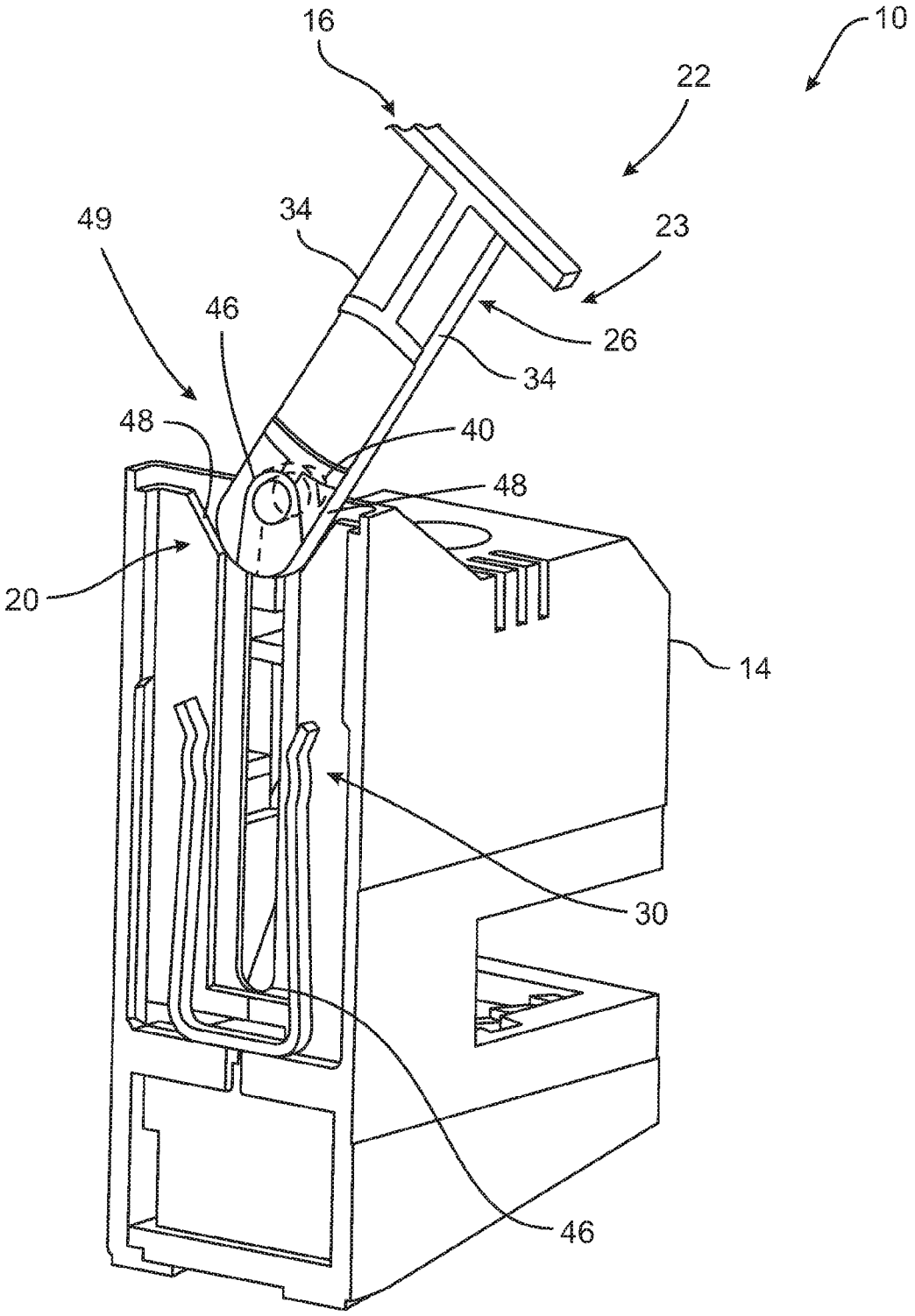
FIG. 4 is a cut away, perspective view of the fuse holder of FIG. 1 and showing the fuse shuttle in the open, fuse-loading position in a second pivoted orientation to assist loading.
Figure 5:
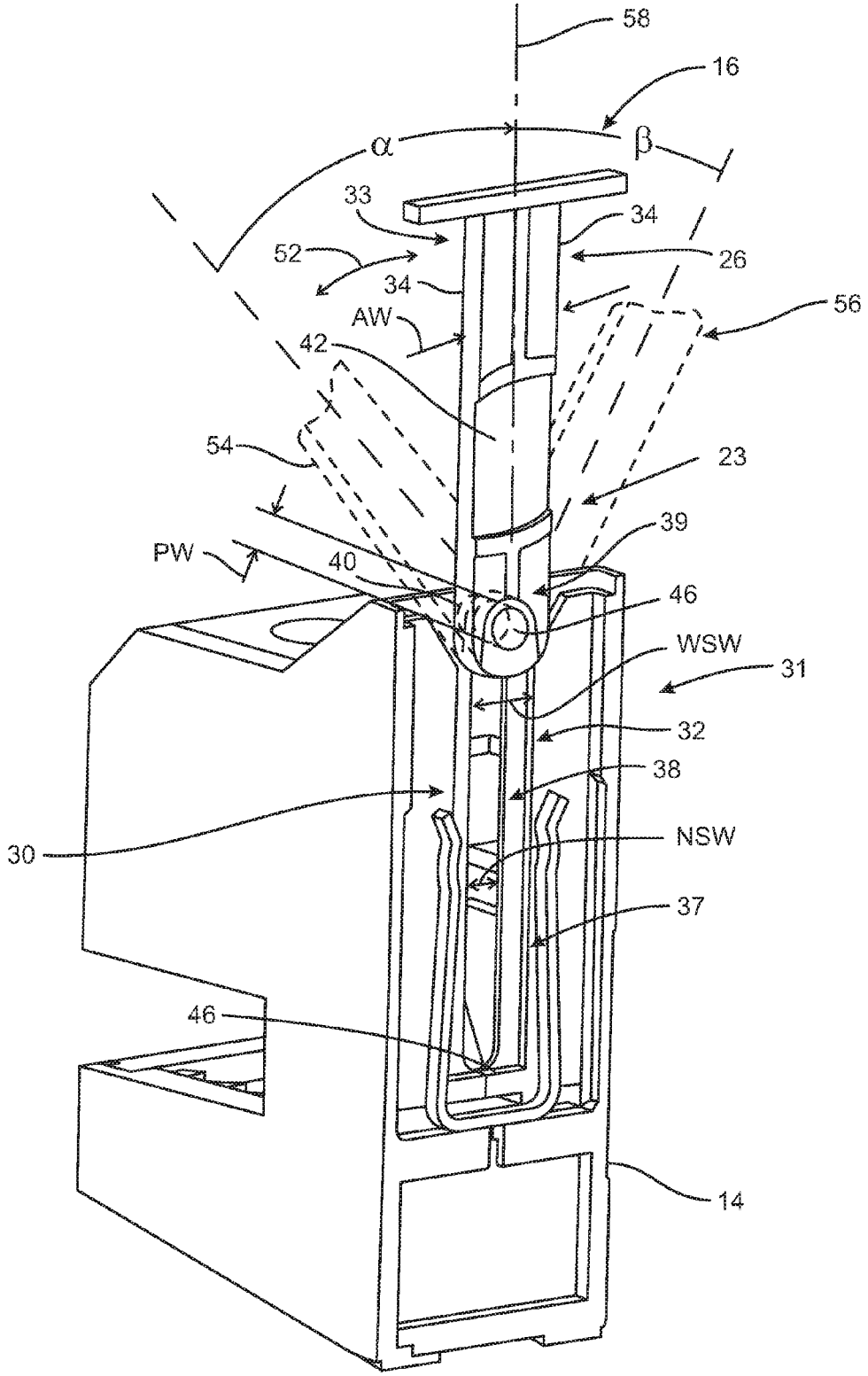
FIG. 5 is a partial, cut away, perspective view of the fuse holder of FIG. 1, showing an arm of the fuse shuttle cooperating with the second portion of the housing.

Referring now to FIGS. 4 and 5, the fuse shuttle guiding features 23 and the housing guiding features 30 are shown in greater detail.

As shown in FIG. 5, the housing guiding features 30 of the housing 14 may include first sliding housing guiding features 31 in the form of a void in the form of a first wide, vertically extending, longitudinal slot 32. The first wide slot 32 cooperates with first sliding fuse shuttle guiding features 33 in the form of, for example, opposed end faces 34 of the first arm 26 of the fuse shuttle 16. As shown, for example, the first wide slot 32 has a wide slot width WSW that is slightly larger than arm width AW of first arm 26.

Figure 2:
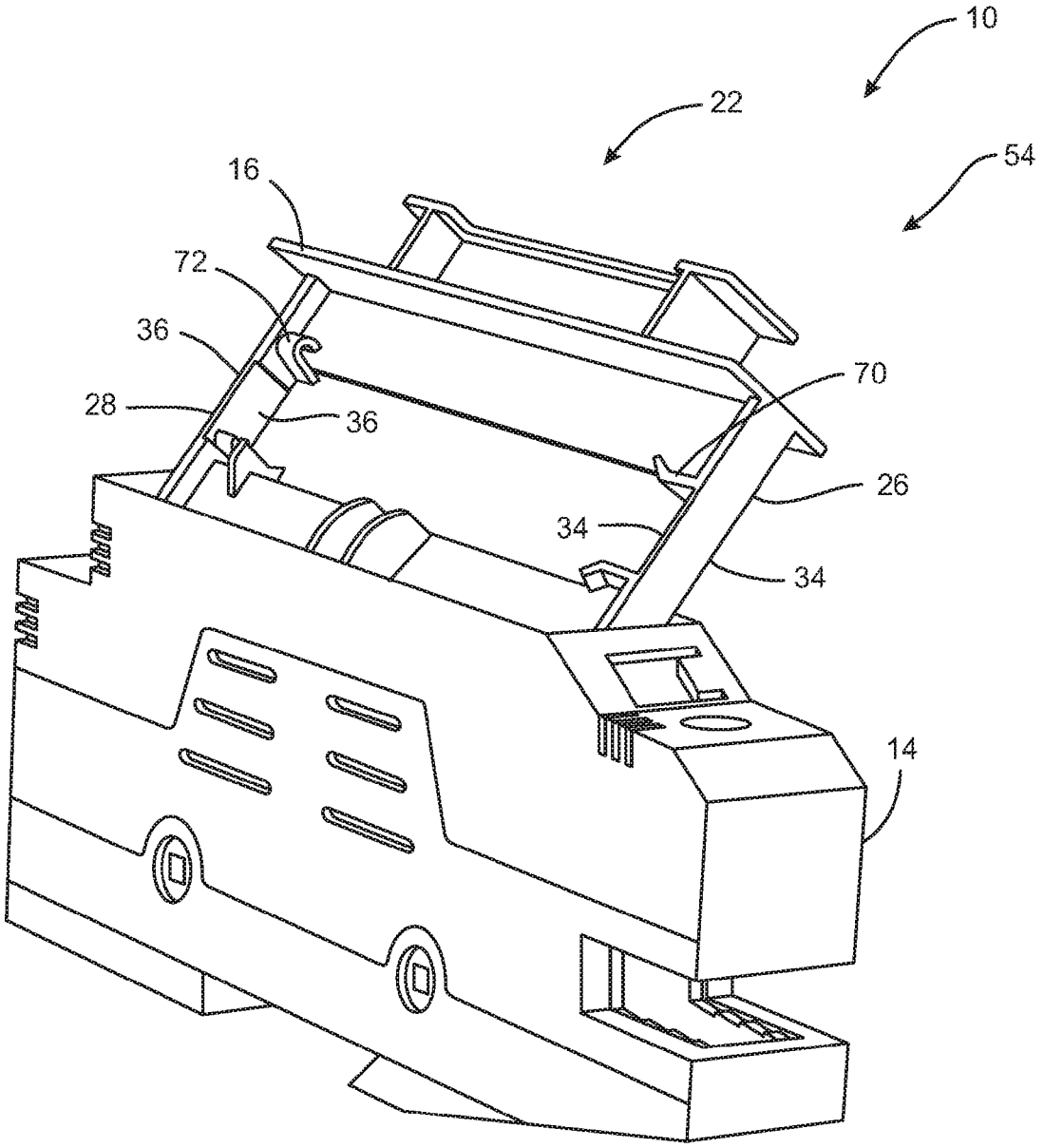
FIG. 2 is a perspective view of the fuse holder of FIG. 1, showing the fuse shuttle in an open, fuse-loading position in a first loading position or first limited pivot position to assist loading.

It should be appreciated that, preferably, first sliding housing guiding features 31 of the housing 14 may further include a second wide, vertically extending, longitudinal slot (not shown) for cooperation with first sliding fuse shuttle guiding features 23 in the form of, for example, opposed end faces 36 of the second aim 28 (see FIGS. 1 and 2).

It should be appreciate that the opposed end faces 34 and 36 of the arms 26 and 28 and the first and second wide, vertically extending, longitudinal slots in the housing 14 may be sufficient to contain the fuse shuttle 16 so that it is in slidable cooperation with the housing 14 in the first portion 18 of the housing 14 (see FIG. 1). However and as shown in FIG. 5, the housing guiding features 30 of the housing 14 may further include additional features in addition to the opposed end faces 34 and 36 of the arms 26 and 28 and the wide, vertically extending, longitudinal slots in the housing 14.

For example and as shown in FIG. 5, the housing guiding features 30 of the housing 14 may include second sliding housing guiding features 37 that cooperate with second sliding fuse shuttle guiding features 39. For example, second sliding housing guiding features 37 may be in the form of a void in the form of a first narrow, vertically extending, longitudinal slot 38. The first narrow slot 38 is sized to slidingly accept a second sliding fuse shuttle guiding feature 39 in the form of a first protrusion 40 extending from an exterior side face 42 of the first arm 26. The first protrusion 40 may for simplicity be a cylindrical protrusion, for example a pin, but other geometric and non-geometry shapes may be used.

As shown, for example, the first narrow slot 38 has a narrow slot width NSW that is slightly larger than protrusion width PW of first protrusion 40 on the first arm 26. It should be appreciated that, preferably, the second sliding housing guiding features 37 of the housing 14 may further include a second narrow, vertically extending, longitudinal slot (not shown) for cooperation with second sliding fuse shuttle guiding features 39 in the form of a second protrusion (not shown) extending from an exterior side face 44 of the second arm 28 (see FIGS. 1 and 2).

The housing 14 may form stops 46 on opposed ends of the narrow slot 38. The housing 14, first narrow slot 38 and stops 46 serve to trap the first protrusion 40 in the first slot 38, preventing the fuse shuttle 16 from separating from the housing 14.

Referring again to FIG. 4, the fuse shuttle 16 is shown pivotally cooperating with the housing 14 in the second portion 20 of the housing 14. In this second portion 20, the fuse shuttle 16 is permitted to pivot because the fuse shuttle 16 includes fuse shuttle pivoting guiding features 47. These guiding features 47 include the first protrusion 40 of first arm 26 which is fitted into the first slot 38 and against the upper one of the stops 46. The fuse shuttle 16 pivots about the first protrusion 40 and its pivoting is limited by the opposed end faces 34 of the first arm 26 resting against housing pivoting guiding features 49 including first chamfer faces 48 at upper end of the first wide, vertically extending, longitudinal slot 32.

It should be appreciated that the first portion 18 of the housing 14 may extend so that it is in cooperation with the fuse shuttle 16 for the entire movement of the fuse shuttle 16. In this alternate configuration, the fuse shuttle 16 is restricted to move in slidable cooperation with the housing 14 for the entire movement of the fuse shuttle 16. In this configuration the narrow slots and the wide slots in the housing 14 may extend further so that they cooperate with the protrusions and the ends of the arms to maintain the slidable cooperation with the housing 14 for the entire movement of the fuse shuttle 16. In this configuration the stops 46 may be positioned to keep the fuse shuttle 16 permanently secured to the housing 14.

It should be appreciated that the second arm 28 likewise has a second protrusion (not shown) extending from the exterior side face 44 of the second arm 28 which is fitted into a second narrow slot (not shown) in housing 14 and against the upper one of the stops (not shown) in housing 14. The fuse shuttle 16 pivots about the second protrusion (not shown) and its pivoting is limited by the opposed end faces 36 of the second arm 28 resting against second chamfer faces (not shown) at the upper end of the second wide, vertically extending, longitudinal slot.

Referring again to FIG. 5, the fuse shuttle 16 is shown in cooperation with the second portion 20 of the housing 14. When the fuse shuttle 16 is in the second portion 20 of the housing 14, the fuse shuttle 16 may pivot in the direction of arrows 52 from first loading position or first limited pivot position 54 to second loading position or second limited pivot position 56. The fuse shuttle 16 may pivot from arm sliding centerline 58 an angle $\alpha$ to first loading position 54 and an angle $\beta$ to second loading position 56. The angles $\alpha$ and $\beta$ may be from, for example, 0 to 90 degrees. For example, the angles $\alpha$ and $\beta$ may be from, for example, 0 to 45 degrees. For example, the angles $\alpha$ and $\beta$ may be from, for example, 15 to 60 degrees.

For example, the angles $\alpha$and $\beta$ may be from, for example, at least 10 degrees. For example, the angles $\alpha$and $\beta$ may in total, for example, be least 20 degrees.

Figure 6:
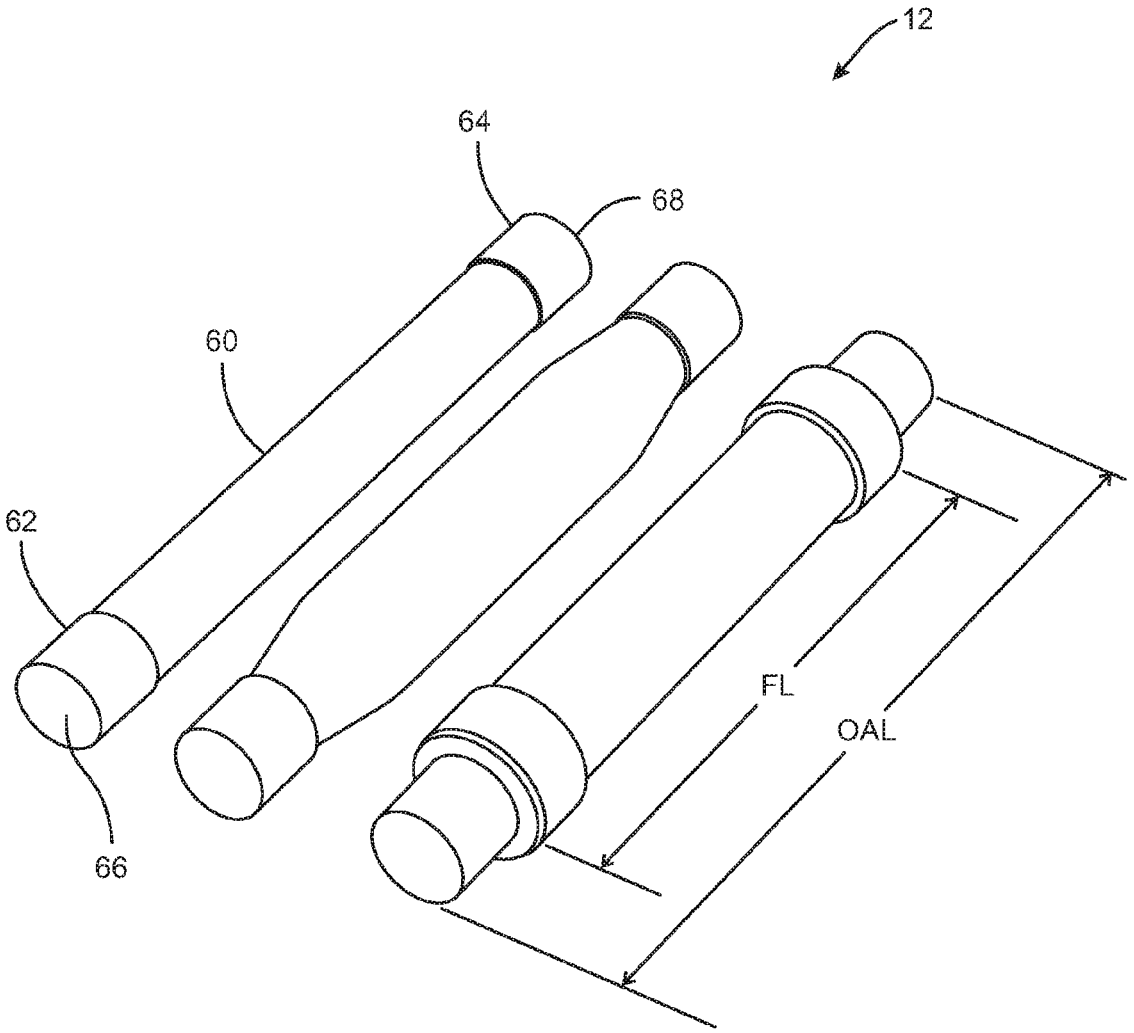
FIG. 6 is a perspective view of fuses that may be used in the fuse holder of FIG. 1.

Referring now to FIGS. 6-11, the fuse 12 is shown in cooperation with the fuse holder 10. While the fuse 12 may have any shape, typically and as shown in FIG. 6, the fuse 12 is generally cylindrical. The fuse 12, as shown has a body 60. As shown the fuse 12 may have one of many shapes and diameters and still be used in the same fuse holder. The fuse 12 also includes a first end or contact zone 62 and an opposed second end or contact zone 64. The first end 62 defines a first end face 66 and the second end 64 defines a second end face 68. The end faces 66 and 68 define a fuse over all length OAL and the first end 62 and the second end 64 define a fuse length FL therebetween. The fuse 12 may be any commercially available fuse. The first end 62 and the second end 64 are preferable made with a periphery that is electrically conductive, for example a metal, for example copper or aluminum.

Figure 7:
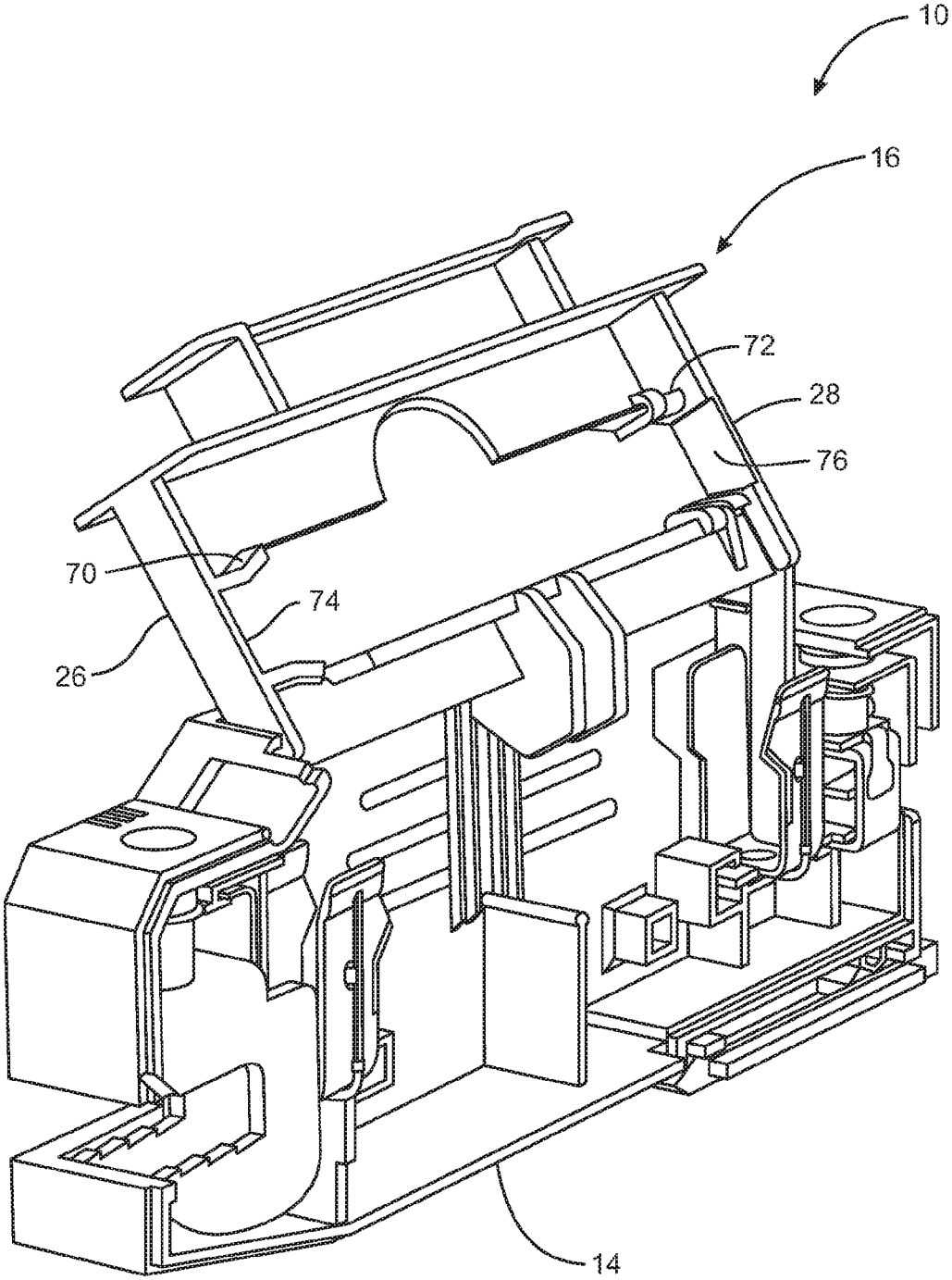
FIG. 7 is a partially cut away, perspective view of the fuse holder of FIG. 1 and showing the fuse shuttle in the open, fuse-loading position in a second loading position or second limited pivot position to assist loading.

Referring now to FIGS. 7-11, the fuse shuttle 16 of the holder 10 is shown in cooperation with the fuse 12 and with the housing 14. As shown in FIG. 7, the fuse shuttle 16 of the holder 10 may include a first receptacle 70 for receiving and containing the first end 62 of the fuse 12. Similarly, the fuse shuttle 16 of the holder 10 may include a second receptacle 72 for receiving and containing the second end 64 of the fuse 12. It should be appreciated that the first receptacle 70 and the second receptacle 72 may be connected to an suitable location on the fuse shuttle 16. For simplicity and as shown in FIG. 7, the first receptacle 70 may extend inwardly from interior side face 74 of the first arm 26. Similarly, the second receptacle 72 may extend inwardly from interior side face 76 of the second arm 26.

Referring now to FIGS. 8-11, the fuse 12 is shown being installed into the receptacles 70 and 72 of the fuse shuttle 16 of the holder 10. It should be appreciated that the fuse 12 may be fitted into opening 78 formed in the fuse shuttle 16 in any suitable fashion. For example, the fuse may be inserted from first side of the fuse shuttle 16 in the direction of arrow 80 or from second side of the fuse shuttle 16 in the direction of arrow 82. If the first receptacle 70 and the second receptacle 72 are both resilient, the fuse 12 may be inserted in a direction normal or perpendicular to longitudinal axis 84 of the opening of the fuse shuttle 16.

Figure 8:
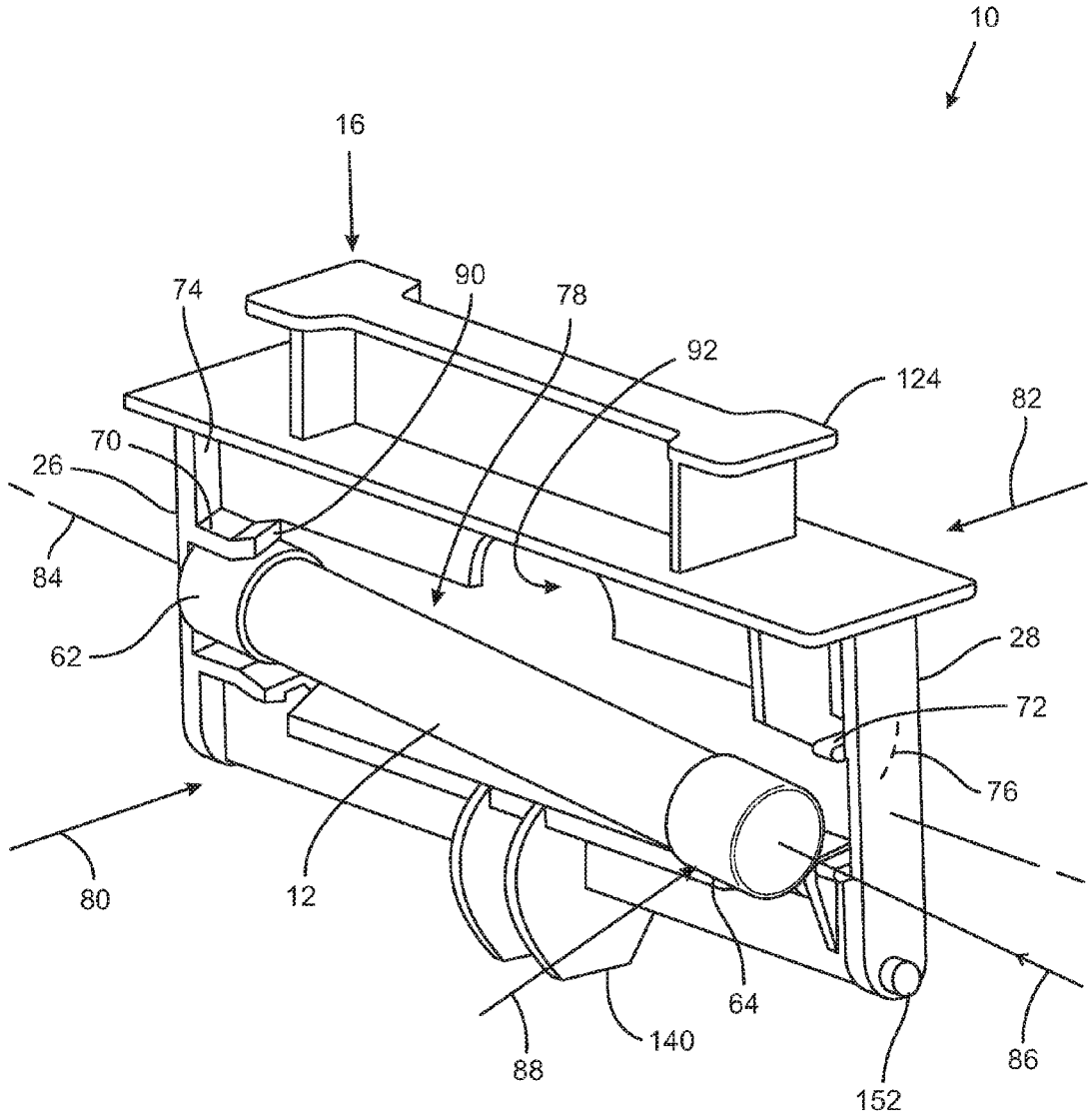
FIG. 8 is a partial perspective view of the fuse shuttle of FIG. 2, showing one end of the fuse loaded in the fuse shuttle.

As shown in FIG. 8, the fuse 12 may be inserted in a combination of; first, in a direction generally axially in the direction of arrow 86; and second, in a direction generally transverse or radially in the direction of arrow 88. With this insertion arrangement, the first end 62 of fuse 12 is inserted into first receptacle 70 in the direction of arrow 86. Then, the second end 64 of fuse 12 is inserted into second receptacle 72 in the direction of arrow 88. In this arrangement, the first receptacle 70 may be rigid, while the second receptacle 72 is preferably resilient. To assist in guiding the first end 62 of the fuse 12 into the first receptacle 72, the first receptacle 72 may, as shown, include a guiding chamfer 90 extending inwardly. The opening 78 may include a finger area 92 for accommodation of a finger or thumb of the fuse installer.

Figure 9:
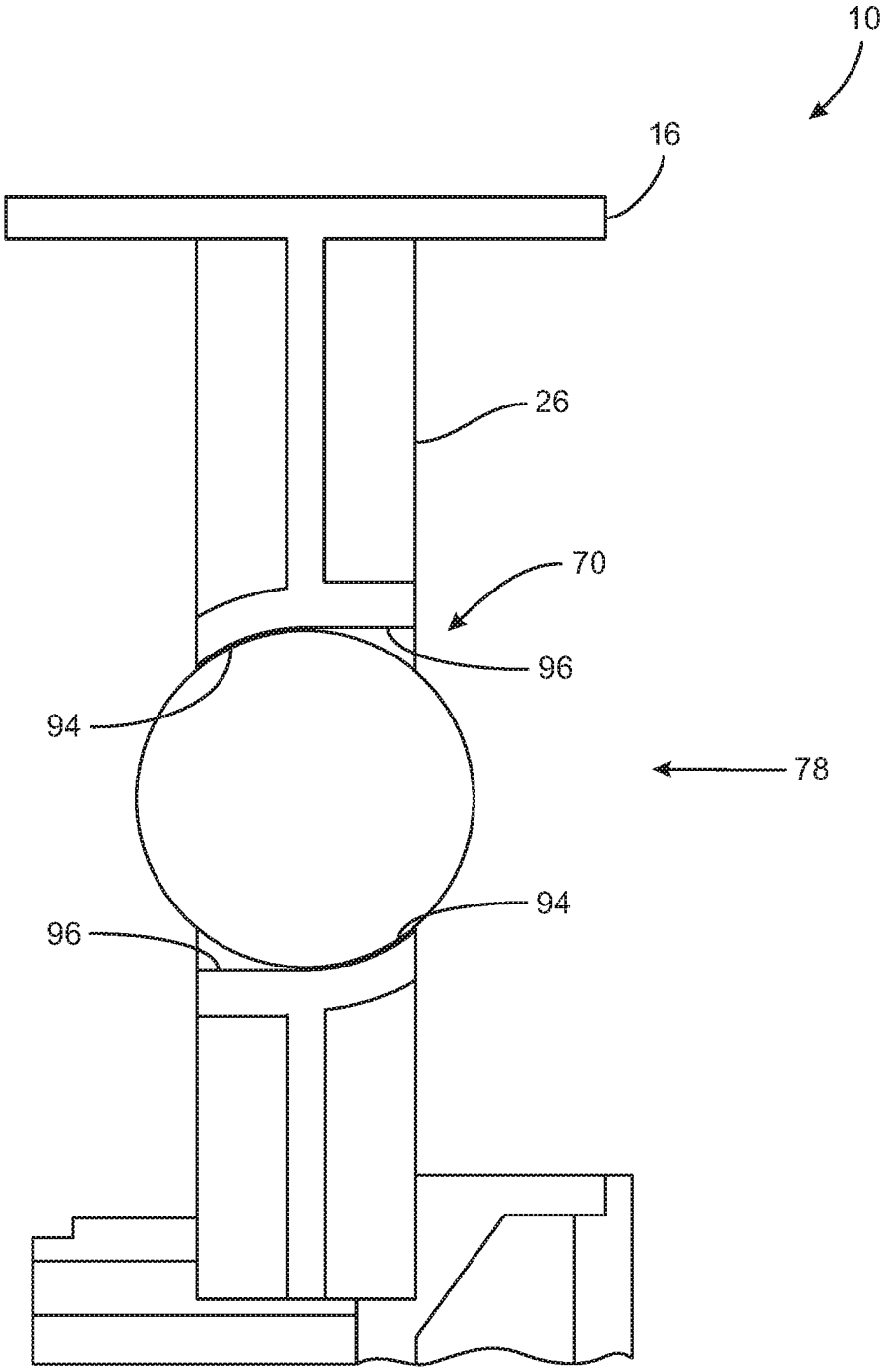
FIG. 9 is a cross sectional view of FIG. 8 along the lines 9-9 in the direction of the arrows.

Referring now to FIG. 9, the first receptacle 70 is shown in greater detail. The first receptacle 70 is, as shown, rigid. Because the fuse 12 is inserted into first receptacle 70 in the generally axial, but partially radial direction of arrow 86 (see FIG. 8), a cylindrical shape for the first receptacle 70 may not be optimum. As shown in FIG. 9, the first receptacle 70 may include opposed closely conforming portions 94 and opposed relieved portions 96. The opposed relieved portions 96 assist in loading the fuse in the generally axial, but partially radial direction of arrow 86. The opposed relieved portions 96 may be arcuate or may be straight.

The opposed closely conforming portions 94 provide for a sufficiently secure holding of the fuse 12 while it is in transit to the operational position 24 (see FIG. 3) and while it is being connected to terminals 102. The opposed closely conforming portions 94 are preferably arcuate and may be concave and cylindrical and may be slightly larger than the diameter of the first end 62 of the fuse 12.

Figure 10:
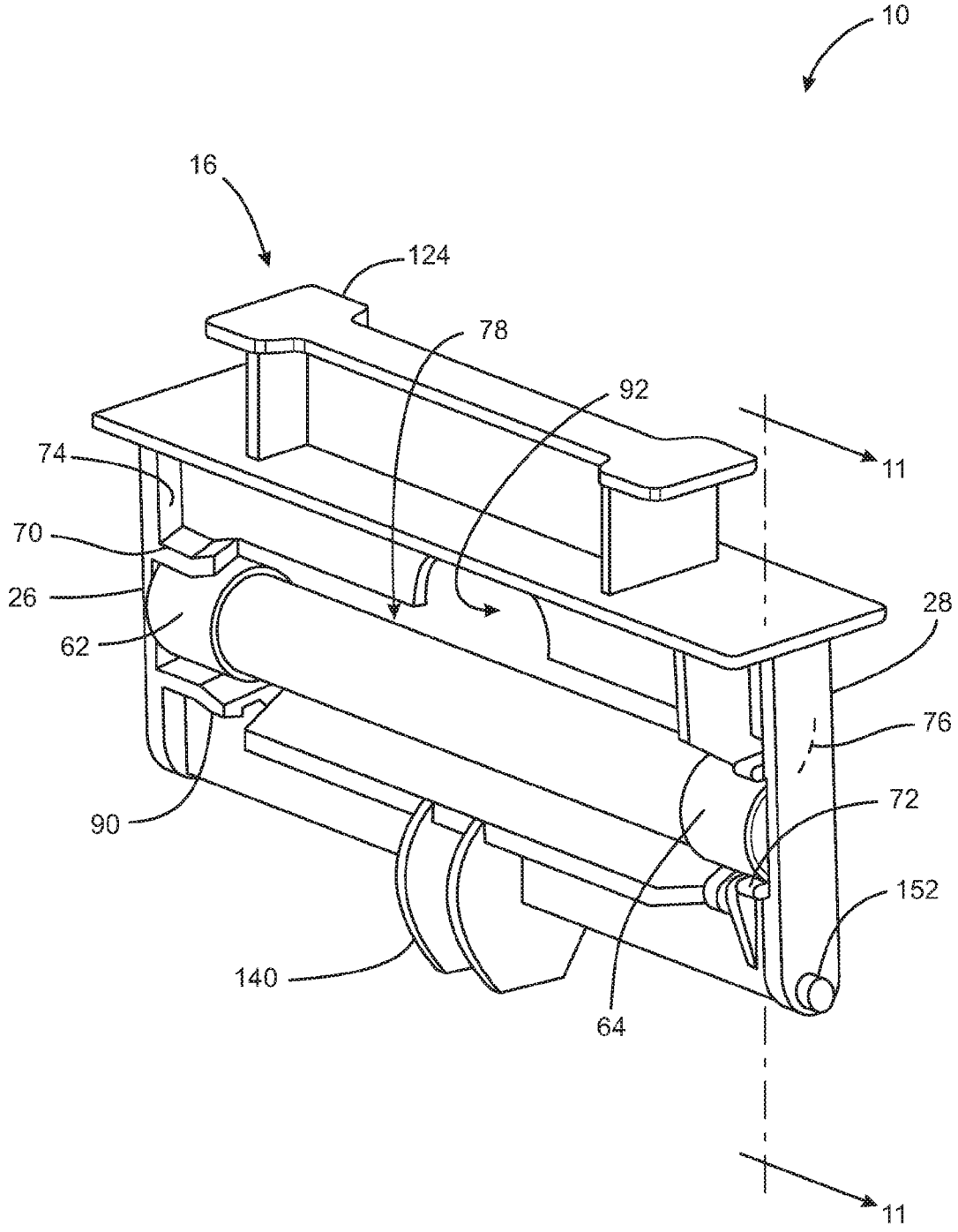
FIG. 10 is a partial perspective view of the fuse shuttle of FIG. 2, showing both ends of the fuse loaded in the fuse shuttle.
Figure 11:
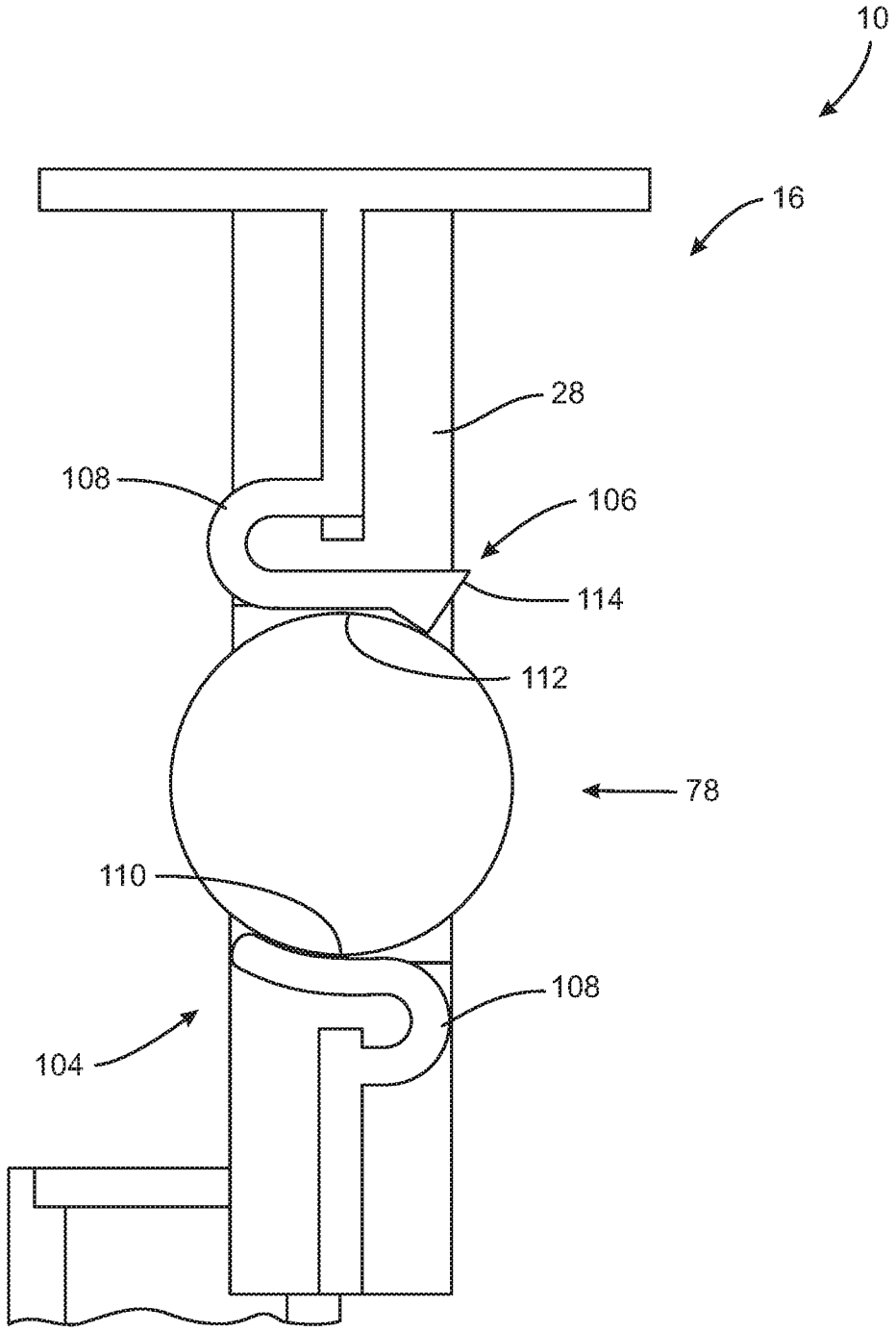
FIG. 11 is a cross sectional view of FIG. 10 along the lines 11-11 in the direction of the arrows.

Referring now to FIGS. 10 and 11, the second end 64 of the fuse 12 is shown installed in second receptacle 72. In order to permit the installation of the second end 64 of the fuse 12 into second receptacle 72 in a generally radial direction, the second receptacle 72 is preferably resilient.

As shown in FIG. 11, the second receptacle 72 includes a first finger 104 and an opposed second finger 106. One of the fingers 104 and 106, or as shown both, may be moveable or resilient. While the movability or resiliency of the fingers may be accommodated in any suitable way. For example, the fingers may include foam or rubber pads, detents or spring biased hinges. For simplicity and as shown, the fingers 104 and 106 may be made of a resilient material, for example a polymer or composite, and may be cantilevered to provide sufficient resiliency to receive the fuse radially.

As shown in FIG. 11, the fingers 104 and 106 may include an arcuate portion 108 extending from the fuse shuttle 16. The first and second fingers 104 and 106 may further include first and second contact portions 110 and 112, respectively, extending from the arcuate portion 108. The first contact portion 110 may be concave and arcuate and may closely conform to the second end 64 of fuse 12 (see FIG. 10). The second contact portion 112 may be linear and be configured to be in contact with the second end 64 of fuse 12. A stop 114 may be positioned on the distal end of the second contact portion 112 to secure the second end 64 of fuse 12 to the second receptacle 72.

Figure 12:
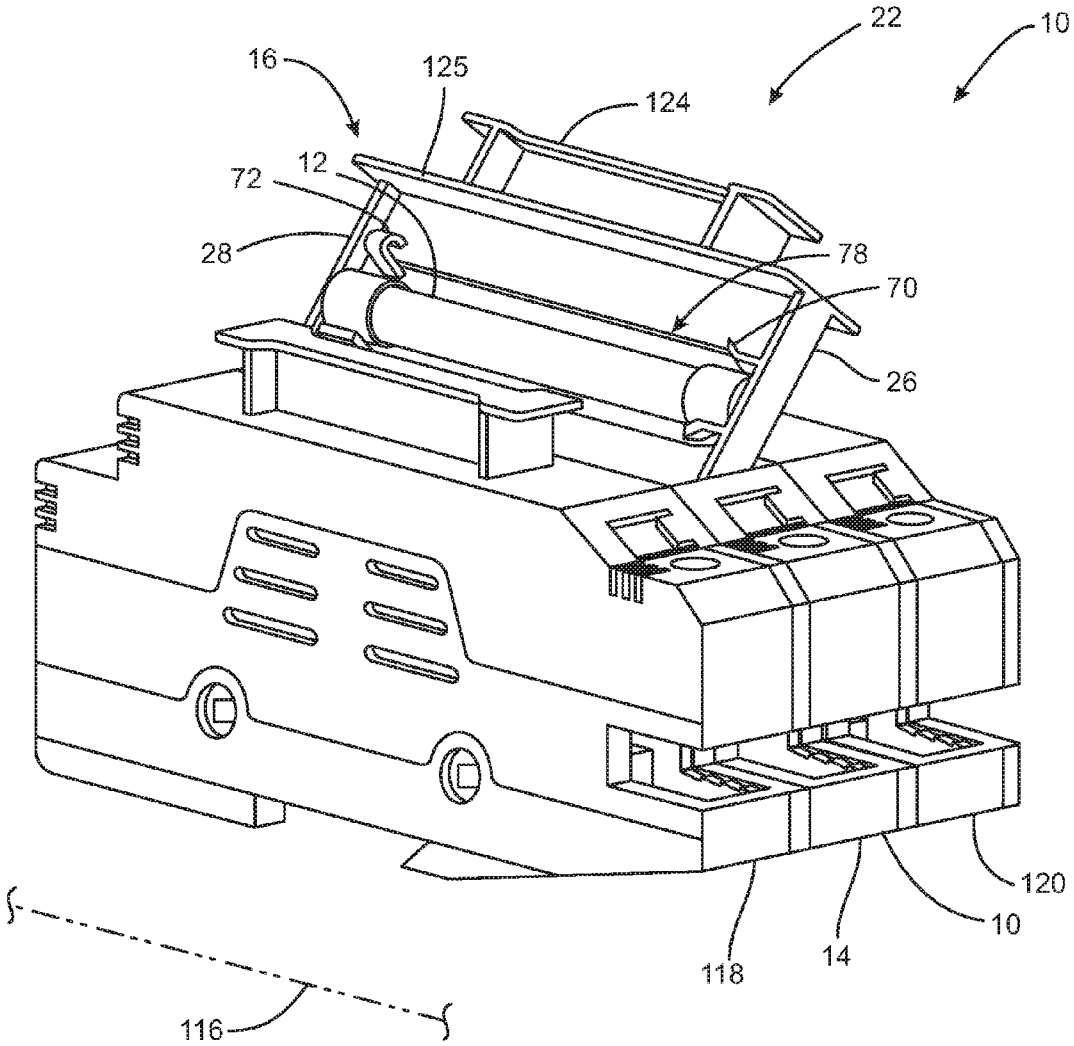
FIG. 12 is a perspective view of the fuse holder of FIG. 1, showing a fuse loaded into the fuse shuttle in the first open, fuse-loading position as shown in FIG. 2 with the fuse holder positioned adjacent other similar fuse holders.
Figure 13:
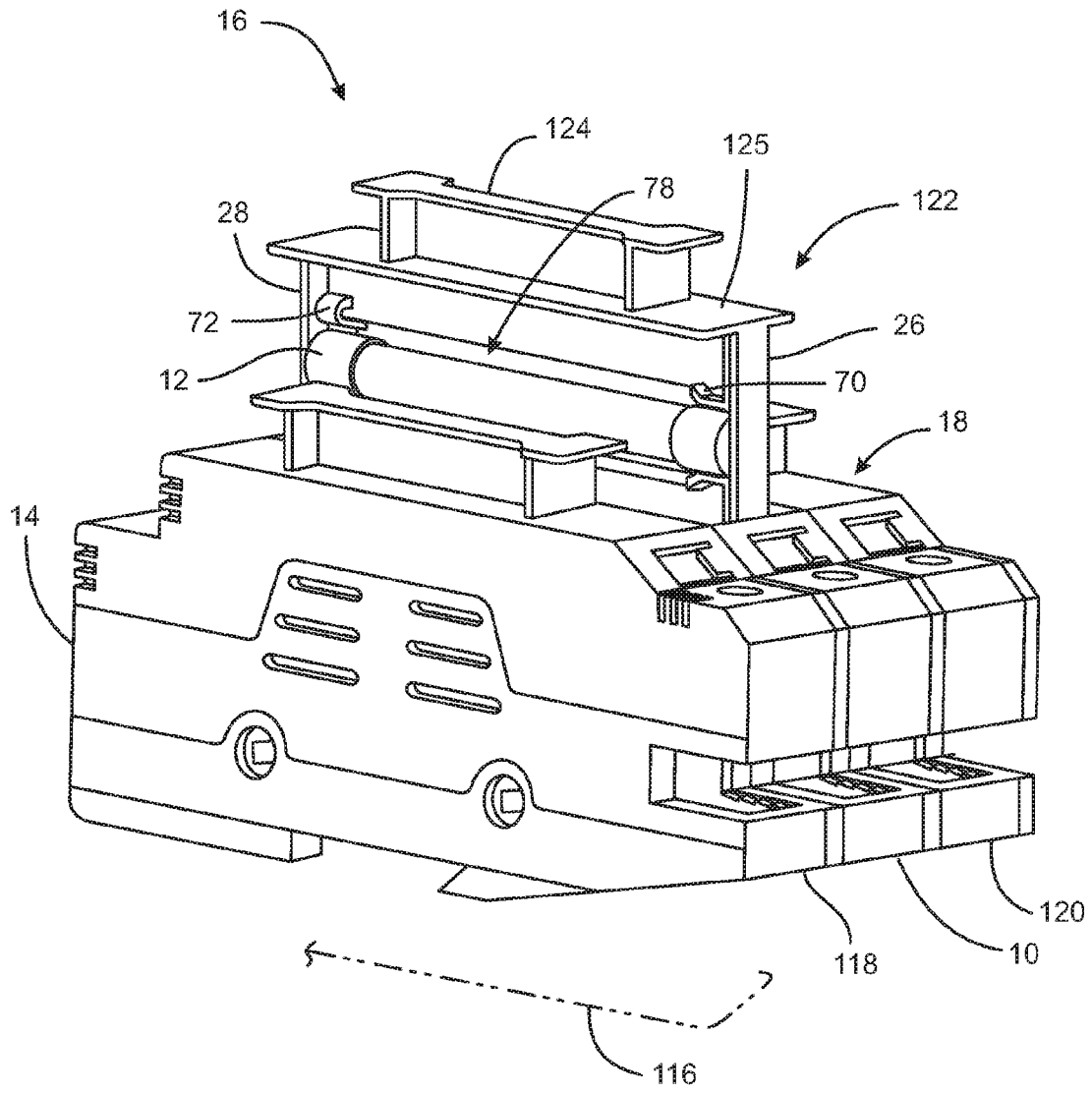
FIG. 13 is a perspective view of the fuse holder of FIG. 1, showing a fuse loaded into the fuse shuttle in a, fuse-transferring position, with the fuse holder positioned adjacent other similar fuse holders.
Figure 14:
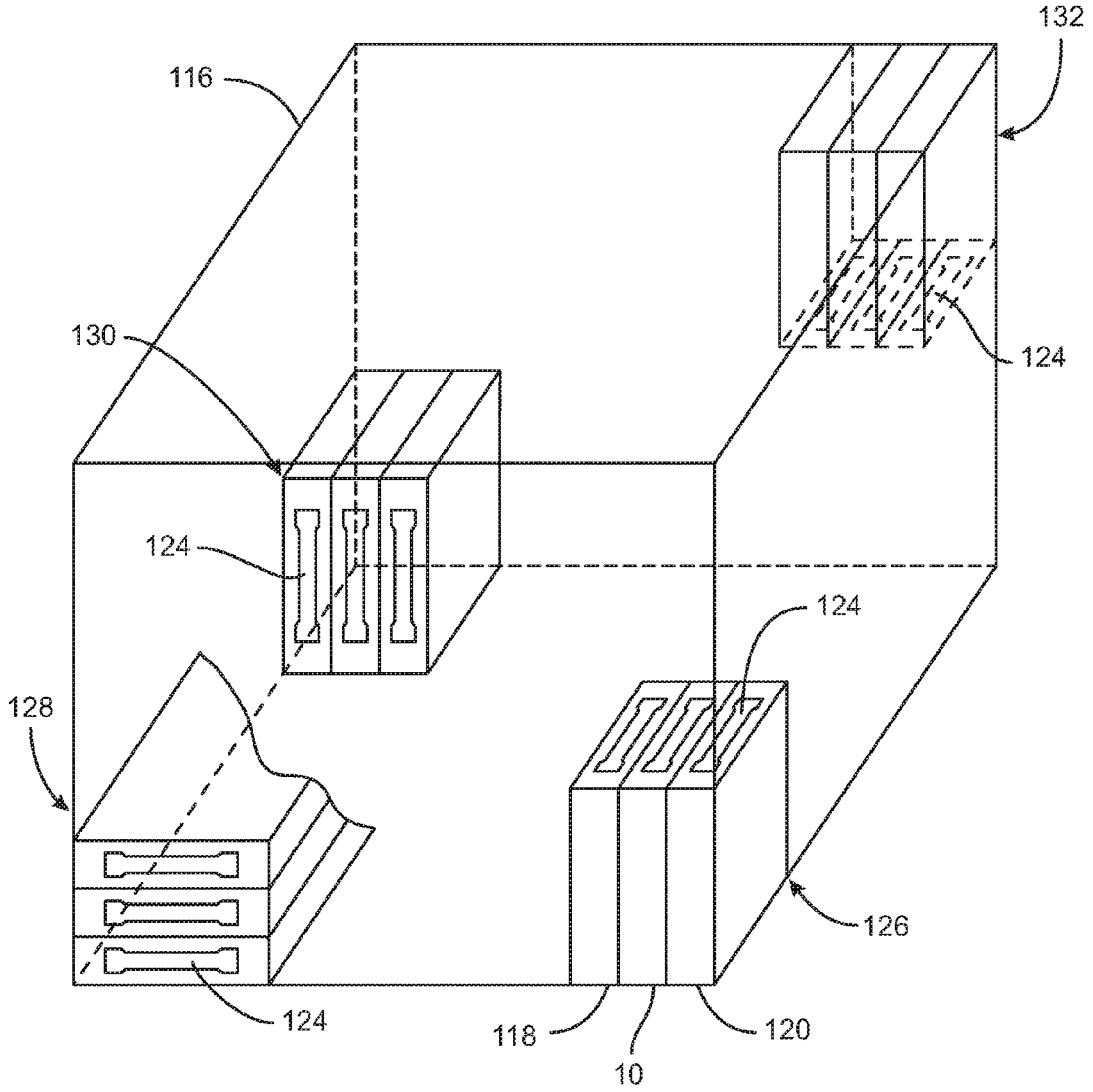
FIG. 14 is a perspective view of the fuse holder of FIG. 1, showing the fuse holder positioned adjacent other similar fuse holders mounted with the handle positioned upwardly, downwardly, longitudinally sideways and transversely sideways.

Referring now to FIGS. 12-14, the fuse holder 10 is shown as part of a fuse box or control panel 116. The fuse box 116 may contain only fuse holders and the holders may be identical or different in size and/or shape. The fuse box 116 may contain other electrical components in addition to fuse holders. For example the fuse box 116 may contain electrical circuitry or controls, for example, conventional electrical components, electronic controls, circuit boards, integrated circuits or any combination thereof.

As shown in FIGS. 12-13, the fuse holder 10 is shown positioned against a second fuse holder 118 and against a third fuse holder 120. The second fuse holder 118 and the third fuse holder 120 may be similar or identical to the first fuse holder 10.

The fuse 12 is inserted into the receptacles 70 and 72 in the loading position 22 as shown in FIG. 12. The fuse shuttle 16 is then rotated into a vertical position 122 as shown in FIG. 13. The fuse shuttle 16 is then advanced inwardly into the first portion 18 of the housing 14. A handle 124 may be provided on the outward portion of the fuse shuttle 16 to assist on orienting and advancing the fuse shuttle 16 relative to the housing 14. The handle 124 may extend outwardly from outer cross beam 125 extending between first arm 26 and second arm 28.

Figure 3:
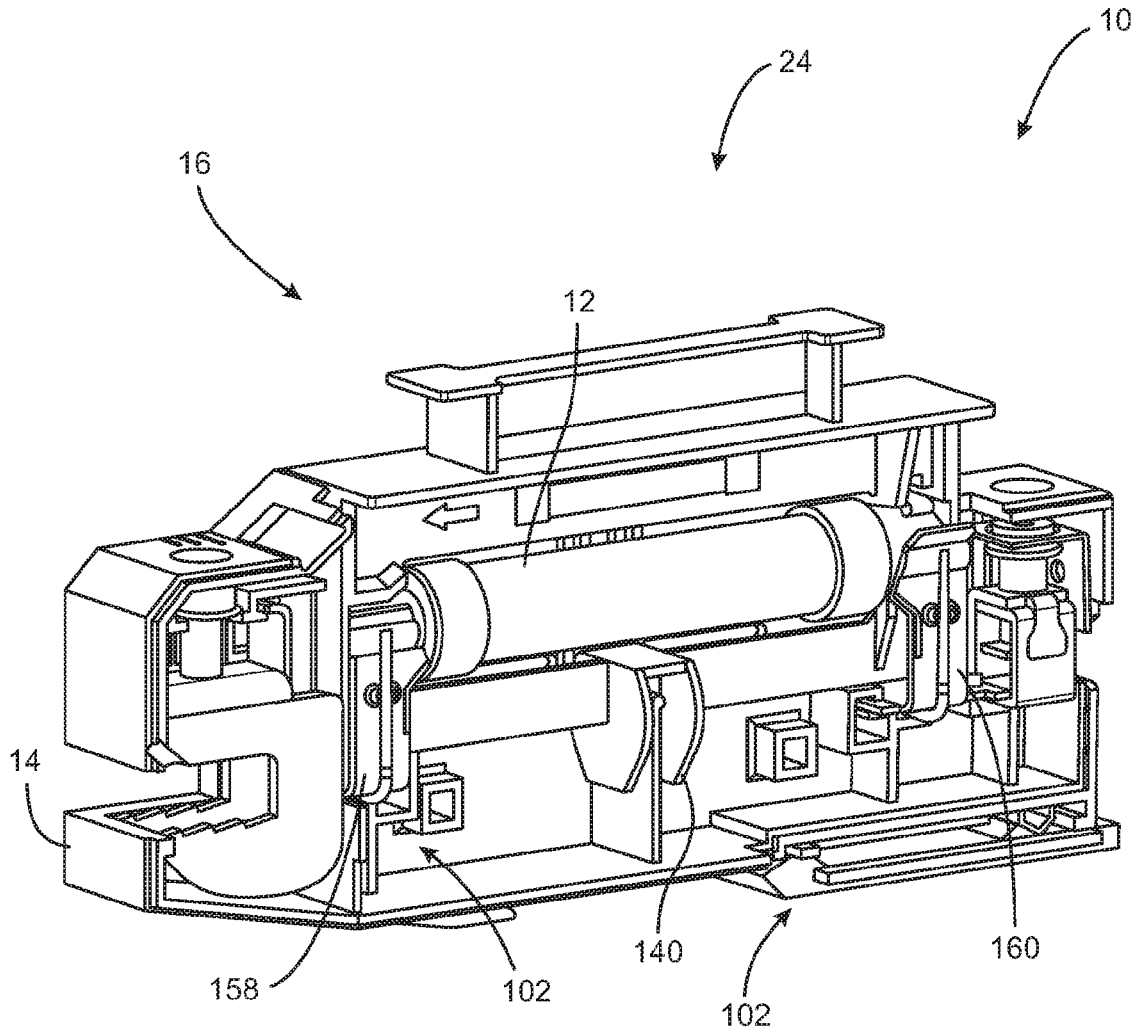
FIG. 3 is a perspective view of the fuse holder of FIG. 1, showing a fuse an operating position.

As shown in FIGS. 12 and 13, it should be appreciated that the pivoting of the fuse shuttle 16 assists in the access to the opening 78 in the fuse shuttle 16 to easily insert the fuse and to advance the fuse shuttle 16 toward the fuse operational position 24 (see FIG. 3).

As shown in FIG. 14, the fuse holders 10, 118 and 120 may be positioned in fuse box 116 with the handle 124 in primary orientation 126 pointing upwardly as is shown in FIGS. 1-13. It should be appreciated that, for convenience and/or for space constraints, the fuse holders may be positioned with the handles pointed in alternate directions. For example, the fuse holders 10, 118 and 120 may be positioned in a first alternate orientation 128 with the handle 124 pointing horizontally. Alternatively, the fuse holders 10, 118 and 120 may be positioned in a second alternate orientation 130 with the handle 124 pointing vertically. Alternatively, the fuse holders 10, 118 and 120 may be positioned in a third alternate orientation 132 with the handle 124 pointing downwardly.

It should be appreciated that gravity will serve to assist in keeping the fuse shuttle 16 in the fuse operational position 24 (see FIG. 3) when the handle 124 is in primary orientation 126 pointing upwardly. In the first alternate orientation 128 with the handle 124 pointing horizontally and in second alternate orientation 130 with the handle 124 pointing vertically, the effects of gravity are nill and the connection of the fuse 12 to terminals 102 serves to positively keep the fuse shuttle 16 in the fuse operational position 24 (see FIG. 3). If, however, the fuse 12 is not in the holder 10 (when a blown fuse is removed and a replacement fuse is not available), the connection of the fuse 12 to terminals 102 is not available to positively keep the fuse shuttle 16 in the fuse operational position 24.

It the third alternate orientation 132 with the handle 124 pointing downwardly, the effects of gravity urge the fuse shuttle 16 out of the fuse operational position 24 (see FIG. 3). Fortunately, the connection of the fuse 12 to terminals 102 serves to positively keep the fuse shuttle 16 in the fuse operational position 24 (see FIG. 3). If, however, the fuse 12 is not in the holder 10 (when a blown fuse is removed and a replacement fuse is not available), the connection of the fuse 12 to terminals 102 is not available to positively keep the fuse shuttle 16 in the fuse operational position 24.

Figure 15:
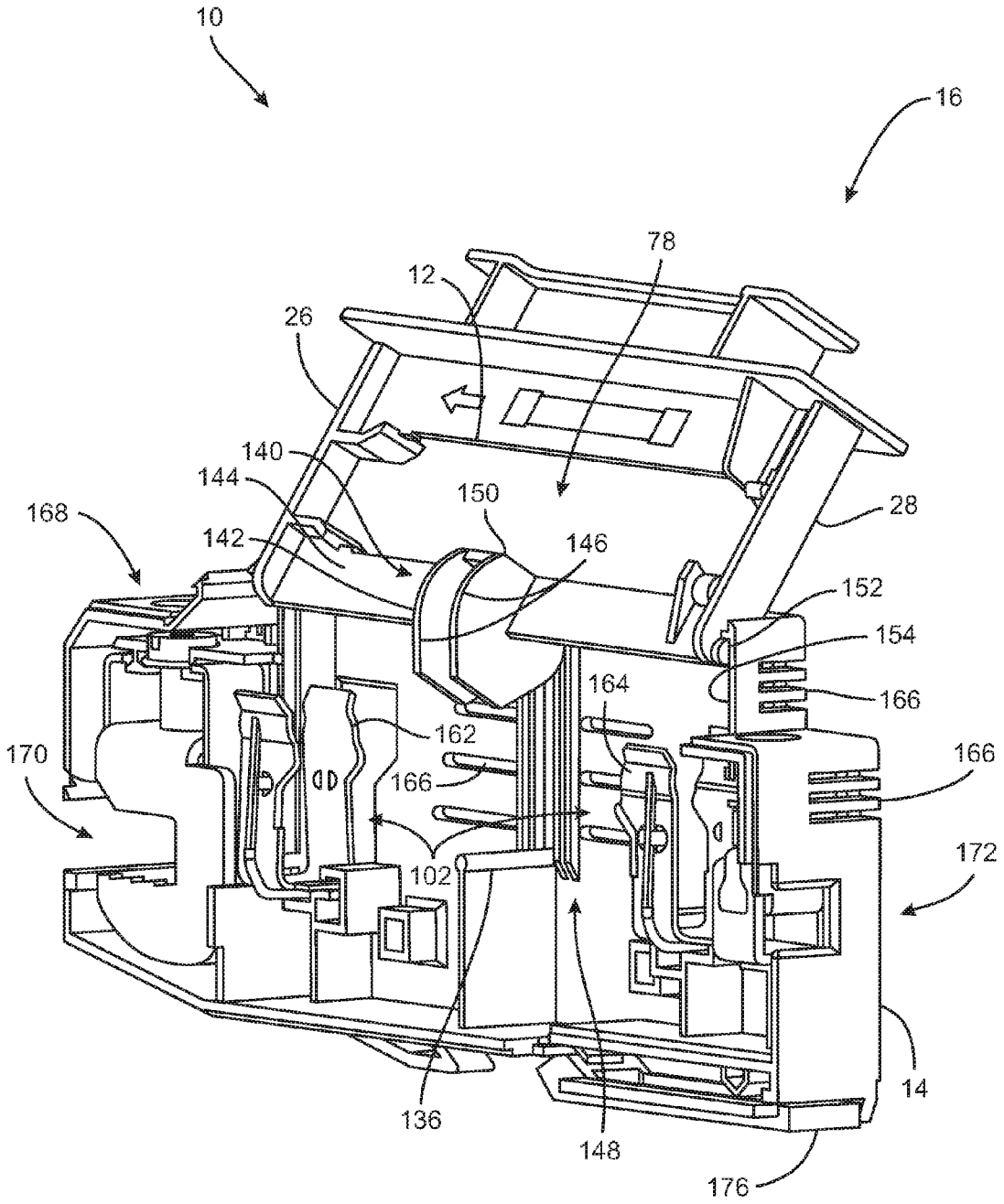
FIG. 15 is a perspective view of the fuse holder of FIG. 1, showing a fuse an operating position in phantom and showing the fuse shuttle in the open, fuse-loading position in the second loading position or second limited pivot position to assist loading.
Figure 16:
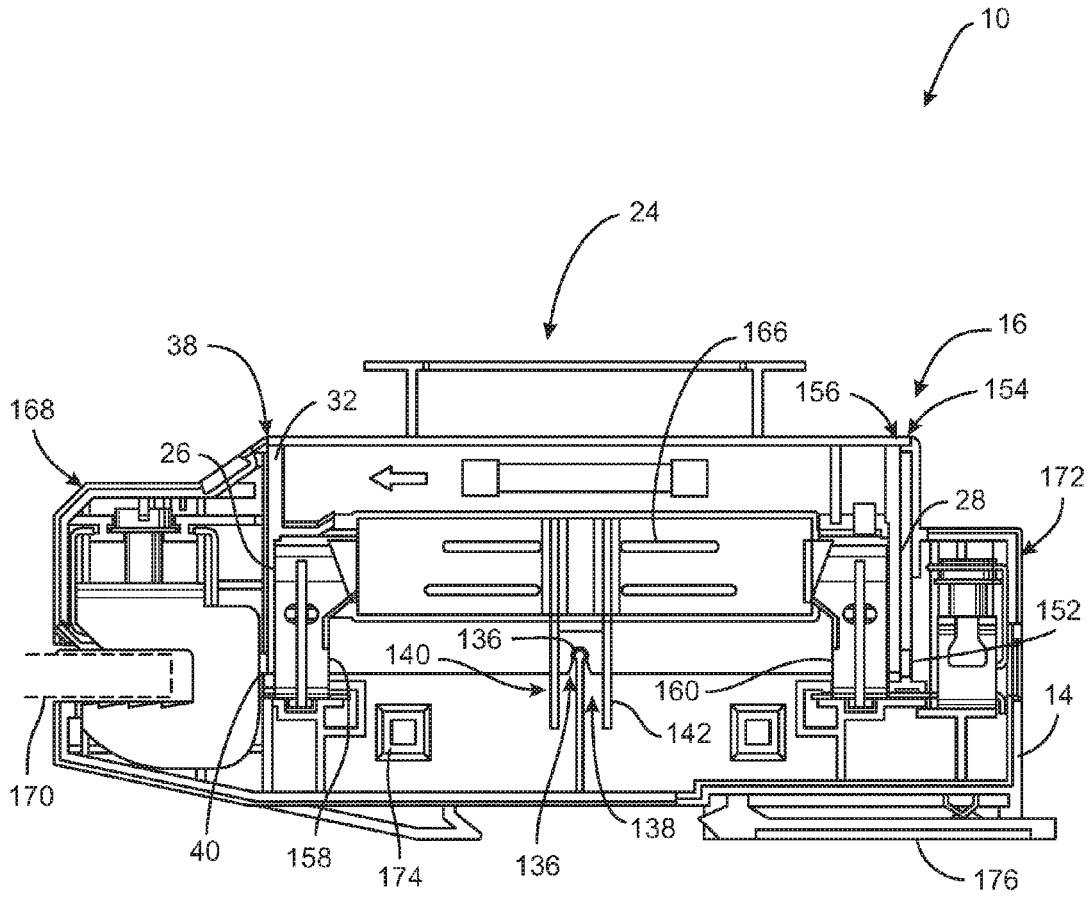
FIG. 16 is a cut away, plan view of the fuse holder of FIG. 1, showing the fuse shuttle in the fuse operating position and showing the securing features.

Referring now to FIGS. 15 and 16, to positively keep the fuse shuttle 16 in the fuse operational position 24 (see FIG. 3), the holder 10 may further include an operational position securing feature 134. The operational position securing feature 134 may include a housing securing feature 136 and a shuttle securing feature 138. The housing securing feature 136 is associated with the housing 14. The housing securing feature 136 may, as shown, be in the form of a rod formed in the housing 14 that cooperates with the shuttle securing feature 138 in the form of a pocket, which may be formed in the fuse shuttle 16.

It should be appreciated that any features that serve as securing features 134 may be formed in the housing 14 and in the fuse shuttle 16. It should be appreciated that the rod 136 may be part of the fuse shuttle 16 and the pocket 138 may be part of the housing 14.

As shown in FIG. 15, to add rigidity to the holder 10 and to further assist in guiding the fuse 12 into the opening 78 in the holder 10, the holder may include a center support 140. The center support 140 may include a pivoting cam 142 extending from inner cross beam 144 of the fuse shuttle 16 extending between the first arm 26 and the second arm 28. The pivoting cam 142 includes cams 146 that cooperate with tracks 148 formed in housing 14.

As shown in FIG. 16, the center support 140, as shown, may include the pocket 138. It should be appreciated that the pocket 138 is preferably formed by a resilient material such that it resiliently receives the rod 136 to secure the fuse shuttle 16 in the fuse operational position 24 (see FIG. 3). The cam 142 further may include a guide surface 150 for guiding the fuse 12 into the fuse shuttle 16.

Referring again to FIGS. 15 and 16, the second arm 26 is shown in greater detail. The second arm 26 includes second protrusion or pin 152, similar to pin 40. The pin 152 is guided along a second narrow, vertically extending, longitudinal slot 154 formed in housing 14. The housing 14 also includes a second wide, vertically extending, longitudinal slot 156 for guiding opposed end faces 36 of the second aim 28.

The terminals 102 may include first terminal 158 and opposed second terminal 160. The first terminal 158 includes a first contoured pocket 162 for cooperation with first end 62 of fuse 12. Similarly, the second terminal 160 includes a second contoured pocket 164 for cooperation with second end 64 of fuse 12. The terminals 158 and 160 are preferably made of a resilient material that may open to receive the fuse 12 and close to secure the fuse 12. The terminals 158 and 160 are preferably made at least partially of an electrically conductive material. For example, the terminals 158 and 160 may be made of a metal, for example copper or aluminum or a combination thereof.

As shown in FIGS. 15 and 16 the housing 14 may include vents 166 cooling the fuse 12 and fuse holder 10.

The fuse holder 10 may include a line-in connection 168 for connecting the fuse holder 10 with the power line and an alternate or additional bus bar line connection 170 for permitting connecting the fuse holder 10 with a bus bar power line.

The fuse holder may further include a load connection 172 for connecting the fuse holder 10 with a load.

The fuse holder may include additional connecting features 174, for example rectangular openings, for connecting the fuse holders together or for connecting the fuse holder to the fuse box.

The fuse holder may include a fuse box mounting feature 176 for connecting the fuse holder 10 to a fuse box.

The housing 14 may be made of any suitable durable material. At least portions of the housing 14 are made of an electrically insulating material. For example the housing 14 may be made of a polymer or a composite. For example the housing may be made of a thermoplastic. The housing may be integral or may be made of components that are fitted together in any suitable way.

The fuse shuttle 16 may be made of any suitable durable material. At least portions of the fuse shuttle 16 are preferably made of a resilient material to provide for the resilient fuse receptacles. For example, the fuse shuttle 16 may be made of a polymer or a composite, for example a thermoplastic. The fuse shuttle 16 may be integral or be made of components that are fitted together in any suitable way.

Figure 17:
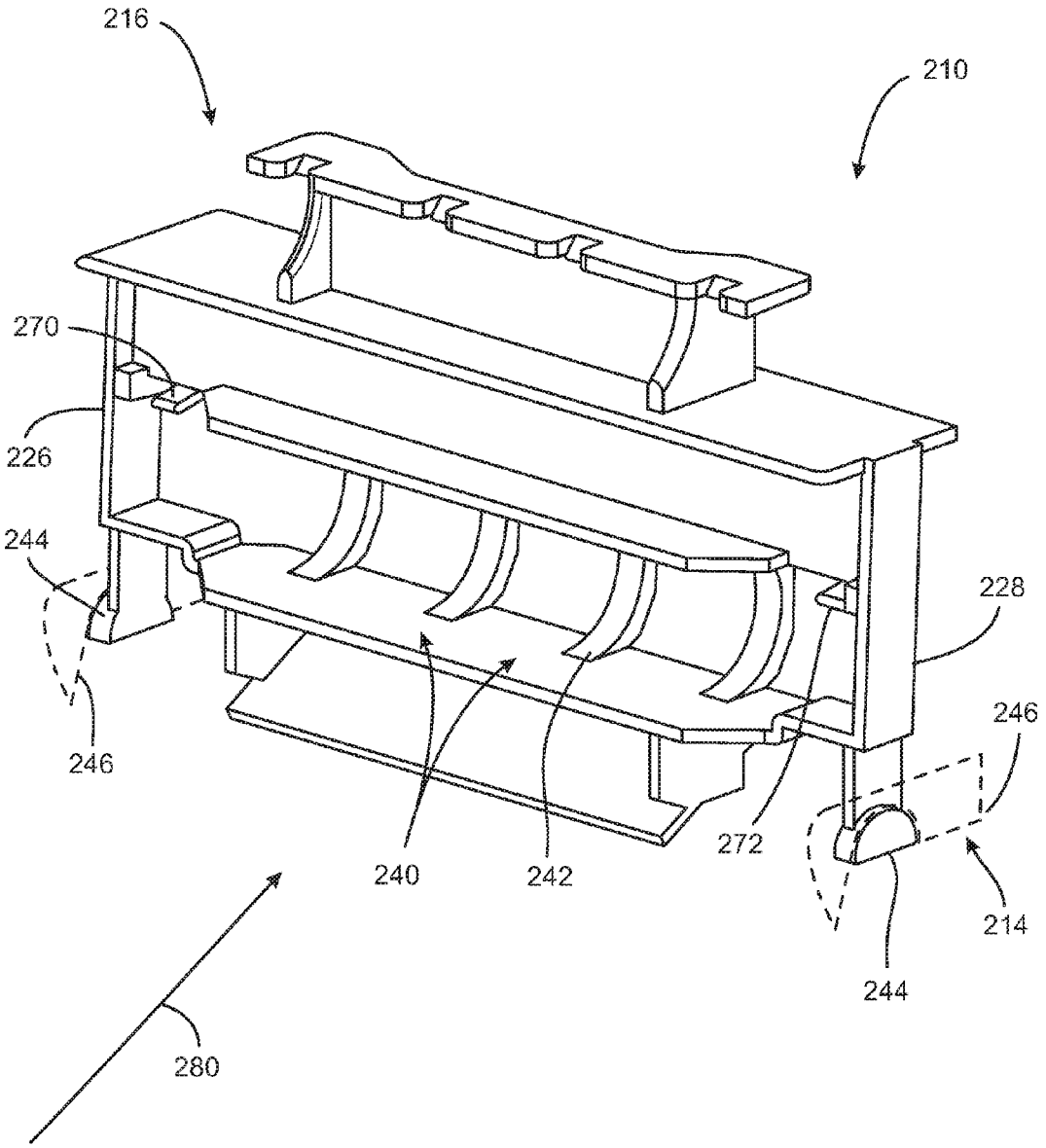
FIG. 17 is a perspective view a fuse shuttle for a fuse holder according to another embodiment of the present invention with a hinged fuse shuttle that provides fuse access from one side of the holder.

Referring now to FIG. 17, another embodiment of the present invention is shown in the form of fuse holder 210. The fuse holder 210 is similar to holder 10 of FIGS. 1-16, except the fuse holder 210 includes a fuse shuttle 216 that is different from the fuse shuttle 16 of fuse holder 10 of FIGS. 1-16. The fuse shuttle 216 slidably and pivotally moves in a housing 214 similar to housing 14 of holder 10. The fuse shuttle 216 provides for loading of a fuse (not shown) in only one direction (in the direction of arrow 280). The fuse shuttle 216 includes a cradle 240 including fingers 242 for containing the fuse in the direction of arrow 280. The fuse shuttle 216 also includes a first receptacle 270 extending from first arm 226 and a second receptacle 272 extending from second arm 228. Hubs 244 on the ends of the arms 226 and 228 cooperate with stops 246 on the housing 214 to contain the fuse shuttle 216 within the housing 214.

Figure 18:
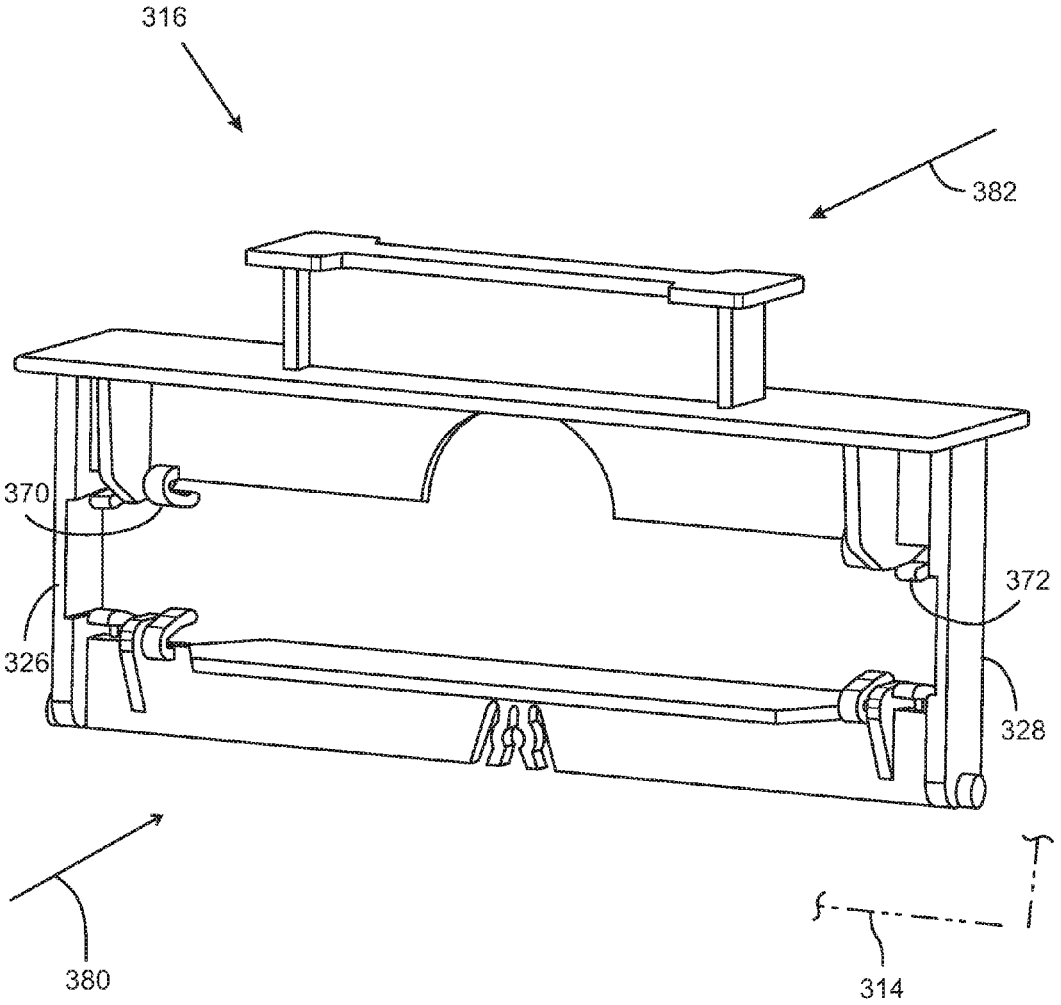
FIG. 18 is a perspective view a fuse shuttle for a fuse holder according to yet another embodiment of the present invention with a hinged fuse shuttle that provides radial fuse access from both sides of the holder.

Referring now to FIG. 18, another embodiment of the present invention is shown in the form of fuse holder 310. The holder 310 is similar to holder 10 of FIGS. 1-16, except the fuse holder 310 includes a fuse shuttle 316 that is different from the fuse shuttle 16 of fuse holder 10 of FIGS. 1-16. The fuse shuttle 316 slidably and pivotally moves in a housing 314 similar to housing 14 of holder 10. The fuse shuttle 316 provides for loading of a fuse (not shown) radially, both direction of arrow 380 and in the direction of arrow 382. The fuse shuttle 316 includes a first receptacle 370 extending from first arm 326 that unlike first receptacle 70 is resilient. The fuse shuttle 316 also includes a second receptacle 372 that, like second receptacle 72, is resilient.

Figure 19:
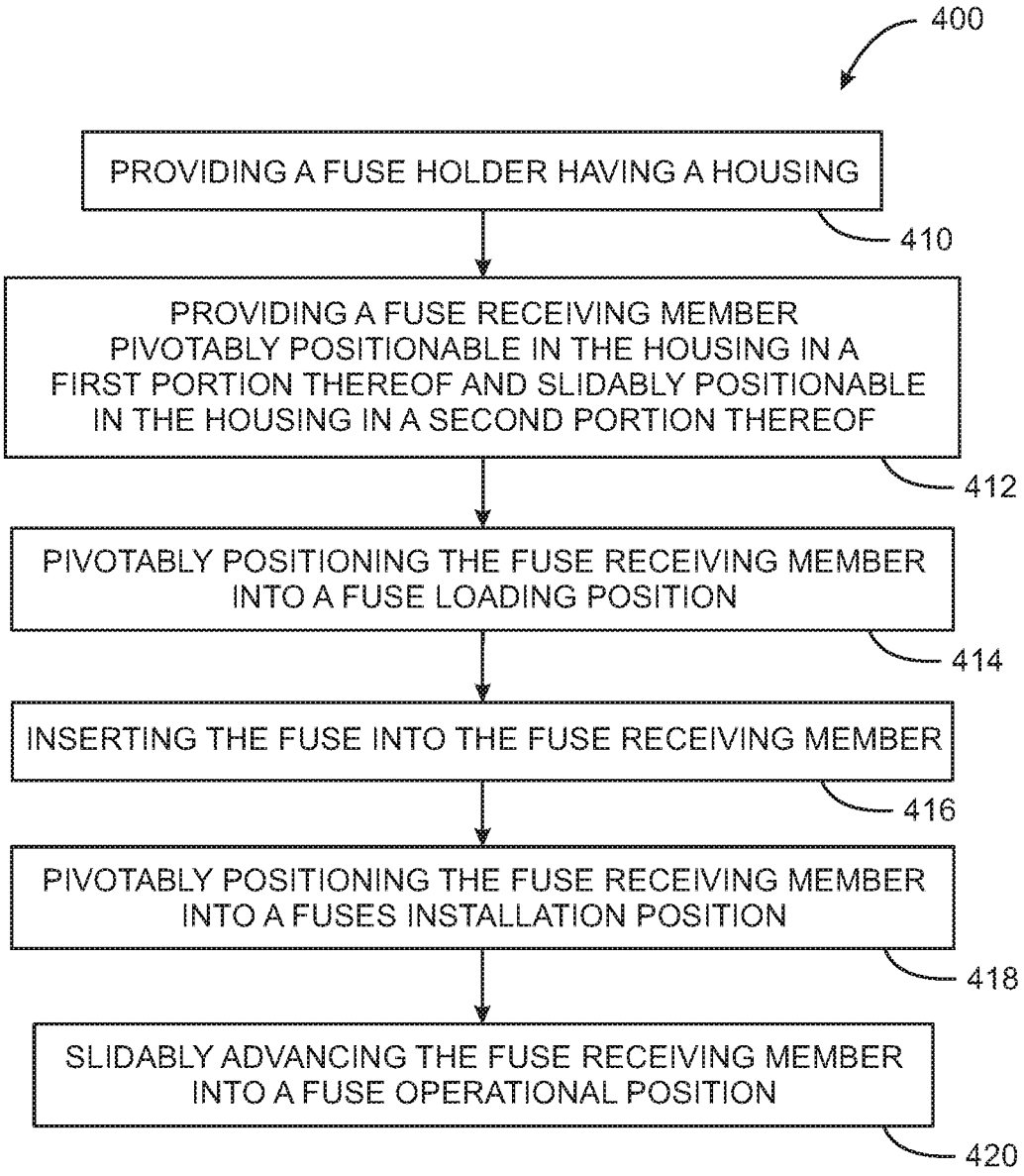
FIG. 19 is a flow chart of another embodiment of the present invention in the form of a method for installing a fuse into a fuse holder.

Referring now to FIG. 19, another embodiment of the present invention is shown in the form of method 400 for installing a fuse in a fuse holder. The method 400 includes step 410 of providing a fuse holder having a housing and a step 412 of providing a fuse receiving member or fuse shuttle pivotally positionable in the housing in a first portion thereof and slidably positionable in the housing in a second portion thereof. The method 400 also includes step 414 of pivotably positioning the fuse receiving member into a fuse loading position and step 416 of inserting the fuse into the fuse receiving member. The method 400 also includes step 418 of pivotably positioning the fuse receiving member into a fuse installation position and step 420 of slidably advancing the fuse receiving member into a fuse operational position.

It should be appreciated that the method 400 may be provided wherein the inserting step 416 may include inserting a first end of the fuse into a first receptacle of the fuse receiving member in an axial direction and inserting an opposed second end of the fuse into a second receptacle of the fuse receiving member in a radial direction.

It should be appreciated that the method 400 may be provided wherein the pivotably positioning step 418 may include pivotably positioning the fuse receiving member into a fuse loading position in one of a clockwise and a counterclockwise direction.

The methods, systems, and apparatus described herein facilitate efficient and economical assembly of an electric machine. Exemplary embodiments of methods, systems, and apparatus are described and/or illustrated herein in detail. The methods, systems, and apparatus are not limited to the specific embodiments described herein, but rather, components of each apparatus and system, as well as steps of each method, may be utilized independently and separately from other components and steps described herein. Each component, and each method step, can also be used in combination with other components and/or method steps.

When introducing elements/components/etc. of the methods and apparatus described and/or illustrated herein, the articles "a", "an", "the", and "the" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Described herein are exemplary methods, systems and apparatus utilizing lower cost materials in a permanent magnet machine that reduces or eliminates the efficiency loss caused by the lower cost material. Furthermore, the exemplary methods system and apparatus achieve increased efficiency while reducing or eliminating an increase of the length of the machine. The methods, system and apparatus described herein may be used in any suitable application. However, they are particularly suited for HVAC and pump applications.

Exemplary embodiments of the fluid flow device and system are described above in detail. The electric machine and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A holder for receiving an electrical fuse having first and second ends, said holder comprising:

a housing;

electrical contacts secured to said housing; and a fuse shuttle, said fuse shuttle slidably fitted to said housing and defining an opening for receiving the electrical fuse, said fuse shuttle having a fuse loading position relative to said housing and a fuse operational position relative to said housing, the fuse loading position spaced from the fuse operational position, said electrical contacts spaced from the electrical fuse when the electrical fuse is positioned in the opening and said fuse shuttle is in the fuse loading position and said electrical contacts engaging the electrical fuse when the electrical fuse is positioned in the receptacle and said fuse shuttle is in the fuse operational position, wherein said housing includes spaced apart first and second housing features, wherein said fuse shuttle includes spaced apart first and second shuttle features; having first and second receptacles, respectively, for receiving the first and second ends, respectively; and wherein each of the first and second shuttle features further includes a cooperation feature for cooperation with the first and second housing features, respectively, the cooperation features and the housing features slidably guide said fuse shuttle in the first portion of said housing.

2. The holder in accordance with claim 1, wherein the fuse includes opposed first and second generally cylindrical ends.

3. The holder in accordance with claim 1, wherein said fuse shuttle includes spaced apart first and second arms.

4. The holder in accordance with claim 3, wherein the first and second receptacles are positioned on the first and second arms, respectively, of said fuse shuttle.

5. The holder in accordance with claim 4, wherein each of the first and second arms include one of the cooperation features for cooperation with the first and second housing features.

6. The holder in accordance with claim 5, wherein the fuse includes opposed first and second generally cylindrical ends.

* * * * *